US011320754B2

(12) United States Patent
Noguchi et al.

(10) Patent No.: US 11,320,754 B2
(45) Date of Patent: May 3, 2022

(54) PROCESS CARTRIDGE AND ELECTROPHOTOGRAPHIC APPARATUS

(71) Applicant: CANON KABUSHIKI KAISHA, Tokyo (JP)

(72) Inventors: Kazunori Noguchi, Suntou-gun (JP); Takeshi Murakami, Yokohama (JP); Harunobu Ogaki, Oyama (JP); Kenta Kamikura, Yokohama (JP); Yuzo Seino, Gotemba (JP); Takashi Kenmoku, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 63 days.

(21) Appl. No.: 16/934,172

(22) Filed: Jul. 21, 2020

(65) Prior Publication Data

US 2021/0026260 A1 Jan. 28, 2021

(30) Foreign Application Priority Data

Jul. 25, 2019 (JP) ..... JP2019-137130
Jun. 30, 2020 (JP) ..... JP2020-113407

(51) Int. Cl.
*G03G 5/147* (2006.01)
*G03G 9/097* (2006.01)
(Continued)

(52) U.S. Cl.
CPC ..... *G03G 5/14734* (2013.01); *G03G 5/04* (2013.01); *G03G 5/071* (2013.01); *G03G 5/072* (2020.05);
(Continued)

(58) Field of Classification Search
CPC ..... G03G 15/087; G03G 21/0005; G03G 21/1676; G03G 21/1814; G03G 5/04;
(Continued)

(56) References Cited

U.S. PATENT DOCUMENTS 4,908,329 A 3/1990 Kanai et al.
4,908,330 A 3/1990 Arai et al.
(Continued)

FOREIGN PATENT DOCUMENTS

JP 2000-066425 3/2000
JP 2001-209207 8/2001
(Continued)

OTHER PUBLICATIONS

U.S. Appl. No. 16/934,164, Takeshi Murakami, filed Jul. 21, 2020.

*Primary Examiner* — Francis C Gray
(74) *Attorney, Agent, or Firm* — Venable LLP

(57) ABSTRACT

The present disclosure provides a process cartridge and an electrophotographic apparatus in which fogging is reduced so as to reduce an amount of toner consumed. A process cartridge configured to be detachably attachable to a main body of an electrophotographic apparatus includes a developing unit containing a toner, and an electrophotographic photosensitive member, wherein the toner is a toner that has a toner particle, and has a metal salt of a polyvalent acid at least on a part of a surface of the toner particle; wherein the metal salt of the polyvalent acid includes at least one kind of metal element selected from metal elements belonging to from Group 3 to Group 13, and a surface layer of the electrophotographic photosensitive member contains an acrylic resin or a methacrylic resin.

17 Claims, 2 Drawing Sheets

(51) Int. Cl.

| | |
|---|---|
| ***G03G 9/087*** | (2006.01) |
| ***G03G 15/08*** | (2006.01) |
| ***G03G 5/04*** | (2006.01) |
| ***G03G 9/113*** | (2006.01) |
| ***G03G 5/07*** | (2006.01) |
| ***G03G 9/093*** | (2006.01) |
| ***G03G 21/18*** | (2006.01) |
| ***G03G 21/16*** | (2006.01) |
| *G03G 21/00* | (2006.01) |

(52) U.S. Cl.
CPC ..... *G03G 9/087* (2013.01); *G03G 9/09328* (2013.01); *G03G 9/09783* (2013.01); *G03G 9/09791* (2013.01); *G03G 9/1136* (2013.01); *G03G 15/087* (2013.01); *G03G 21/1676* (2013.01); *G03G 21/1814* (2013.01); *G03G 21/0005* (2013.01)

(58) Field of Classification Search
CPC ..... G03G 5/0546; G03G 5/071; G03G 5/072; G03G 5/14734; G03G 9/087; G03G 9/09328; G03G 9/09733; G03G 9/09783; G03G 9/09791; G03G 9/1136
See application file for complete search history.

(56) References Cited

U.S. PATENT DOCUMENTS

| | | | | |
|---|---|---|---|---|
| 5,759,291 | A | 6/1998 | Ichinose et al. | |
| 6,060,202 | A * | 5/2000 | Ogawa | G03G 9/0819 399/225 |
| 6,991,881 | B2 | 1/2006 | Ogaki et al. | |
| 6,994,941 | B2 | 2/2006 | Tanaka et al. | |
| 7,001,699 | B2 | 2/2006 | Tanaka et al. | |
| 7,045,261 | B2 | 5/2006 | Tanaka et al. | |
| 7,413,840 | B1 | 8/2008 | Ogaki et al. | |
| 7,551,878 | B2 | 6/2009 | Ogaki et al. | |
| 7,553,594 | B2 | 6/2009 | Ogaki et al. | |
| 7,585,604 | B2 | 9/2009 | Ogaki et al. | |
| 7,622,238 | B2 | 11/2009 | Uematsu et al. | |
| 7,629,102 | B2 | 12/2009 | Ochi et al. | |
| 7,645,547 | B2 | 1/2010 | Okuda et al. | |
| 7,655,370 | B2 | 2/2010 | Kitamura et al. | |
| 7,704,657 | B2 | 4/2010 | Uesugi et al. | |
| 7,718,331 | B2 | 5/2010 | Uematsu et al. | |
| 7,749,667 | B2 | 7/2010 | Kawahara et al. | |
| 7,799,496 | B2 | 9/2010 | Uesugi et al. | |
| 7,838,190 | B2 | 11/2010 | Ogaki et al. | |
| 7,875,410 | B2 | 1/2011 | Ogaki et al. | |
| 7,927,774 | B2 | 4/2011 | Ogaki et al. | |
| 7,931,848 | B2 | 4/2011 | Ochi et al. | |
| 8,457,528 | B2 | 6/2013 | Ochi et al. | |
| 8,669,027 | B2 | 3/2014 | Anezaki et al. | |
| 8,753,789 | B2 | 6/2014 | Ogaki et al. | |
| 8,815,479 | B2 | 8/2014 | Shida et al. | |
| 8,841,052 | B2 | 9/2014 | Watariguchi et al. | |
| 8,846,281 | B2 | 9/2014 | Okuda et al. | |
| 8,865,380 | B2 | 10/2014 | Noguchi et al. | |
| 8,921,020 | B2 | 12/2014 | Murai et al. | |
| 8,974,991 | B2 | 3/2015 | Kawahara et al. | |
| 8,980,508 | B2 | 3/2015 | Okuda et al. | |
| 8,980,509 | B2 | 3/2015 | Noguchi et al. | |
| 9,034,545 | B2 | 5/2015 | Maruyama et al. | |
| 9,068,083 | B2 | 6/2015 | Tanaka et al. | |
| 9,114,565 | B2 | 8/2015 | Kawai et al. | |
| 9,188,888 | B2 | 11/2015 | Okuda et al. | |
| 9,207,550 | B2 | 12/2015 | Okuda et al. | |
| 9,235,144 | B2 | 1/2016 | Yamamoto et al. | |
| 9,274,442 | B2 | 3/2016 | Sato et al. | |
| 9,280,071 | B2 | 3/2016 | Maruyama et al. | |
| 9,280,072 | B2 | 3/2016 | Ogaki et al. | |
| 9,282,615 | B2 | 3/2016 | Yamagishi et al. | |
| 9,304,416 | B2 | 4/2016 | Noguchi et al. | |
| 9,341,964 | B2 | 5/2016 | Ogaki et al. | |
| 9,405,206 | B2 | 8/2016 | Kawaguchi et al. | |
| 9,436,107 | B2 | 9/2016 | Murakami et al. | |
| 9,459,542 | B2 | 10/2016 | Tanaka et al. | |
| 9,507,283 | B2 | 11/2016 | Maruyama et al. | |
| 9,535,343 | B2 | 1/2017 | Nukada et al. | |
| 9,535,347 | B2 | 1/2017 | Watariguchi et al. | |
| 9,575,422 | B2 | 2/2017 | Okuda et al. | |
| 9,599,917 | B2 | 3/2017 | Okuda et al. | |
| 9,651,879 | B2 | 5/2017 | Maruyama et al. | |
| 9,658,543 | B2 | 5/2017 | Murakami et al. | |
| 9,726,992 | B2 | 8/2017 | Sakuma et al. | |
| 9,772,569 | B2 | 9/2017 | Tanaka et al. | |
| 9,791,792 | B2 | 10/2017 | Miyauchi et al. | |
| 9,851,646 | B2 | 12/2017 | Tomono et al. | |
| 10,018,928 | B2 | 7/2018 | Murakami et al. | |
| 10,095,137 | B2 | 10/2018 | Murakami et al. | |
| 10,452,021 | B2 | 10/2019 | Miura et al. | |
| 10,545,453 | B2 | 1/2020 | Iwasaki et al. | |
| 10,642,177 | B2 * | 5/2020 | Nakamura | G03G 5/14791 |
| 10,663,913 | B2 | 5/2020 | Yamaai et al. | |
| 2003/0162111 | A1 * | 8/2003 | Otani | G03G 9/097 430/108.4 |
| 2005/0208402 | A1 | 9/2005 | Tanaka et al. | |
| 2014/0154618 | A1 | 6/2014 | Maruyama et al. | |
| 2015/0185630 | A1 | 7/2015 | Ito et al. | |
| 2016/0139556 | A1 * | 5/2016 | Yamamoto | G03G 9/097 430/105 |
| 2017/0060008 | A1 | 3/2017 | Okuda et al. | |
| 2018/0217522 | A1 * | 8/2018 | Yoshida | G03G 21/0064 |
| 2019/0212667 | A1 * | 7/2019 | Chiba | G03G 9/09775 |

FOREIGN PATENT DOCUMENTS

| | | | | |
|---|---|---|---|---|
| JP | 3938209 | B2 * | 6/2007 | G03G 5/0625 |
| JP | WO2005064414 | A1 * | 7/2007 | G03G 5/047 |
| JP | 2012-093554 | | 5/2012 | |
| JP | 2016-070968 | | 5/2016 | |

* cited by examiner

PROCESS CARTRIDGE AND ELECTROPHOTOGRAPHIC APPARATUS

BACKGROUND OF THE INVENTION

Field of the Invention

The present disclosure relates to a process cartridge and an electrophotographic apparatus.

Description of the Related Art

In an electrophotographic process, in recent years, it is desired to downsize an electrophotographic apparatus and increase the number of printable sheets. In order to adapt to the desire, it is required to further reduce an amount of toner consumed. In order to reduce the amount of toner consumed, it is required to reduce the fogging that occurs due to the toner developing on a non-image area.

In Japanese Patent Application Laid-Open No. 2001-209207, a toner is disclosed which has improved developability and durability, by bonding inorganic fine particles formed of a phosphate-based anion and a zirconium ion to the surface of the toner.

In Japanese Patent Application Laid-Open No. 2000-66425, a technology is disclosed which suppresses the fogging after endurance, by improving wear resistance (mechanical durability) using a radically polymerizable compound onto the surface of an electrophotographic photosensitive member.

SUMMARY OF THE INVENTION

According to the study of the present inventors, in the process cartridges described in the Japanese Patent Application Laid-Open No. 2001-209207 and the Japanese Patent Application Laid-Open No. 2000-66425, the fogging which has been visually confirmed on the image has been improved, but it has been demanded to further reduce the fogging, in point of the reduction of the amount of toner consumed.

Accordingly, an object of the present disclosure is to provide a process cartridge and an electrophotographic apparatus in which the fogging is reduced so as to reduce the amount of toner consumed.

The above object is achieved by the following present disclosure. Specifically, the process cartridge and the electrophotographic apparatus according to the present disclosure are a process cartridge and an electrophotographic apparatus that have a developing unit containing a toner, and an electrophotographic photosensitive member, wherein the toner is a toner that has a toner particle, and has a metal salt of a polyvalent acid at least on a part of the surface of the toner particle; wherein the metal salt of the polyvalent acid includes at least one kind of metal element selected from metal elements belonging to from Group 3 to Group 13, and a surface layer of the electrophotographic photosensitive member contains an acrylic resin or a methacrylic resin.

According to the present disclosure, there can be provided a process cartridge and an electrophotographic apparatus in which the fogging is reduced so as to reduce the amount of toner consumed.

Further features of the present disclosure will become apparent from the following description of exemplary embodiments with reference to the attached drawings.

DESCRIPTION OF THE EMBODIMENTS

Figure 1:
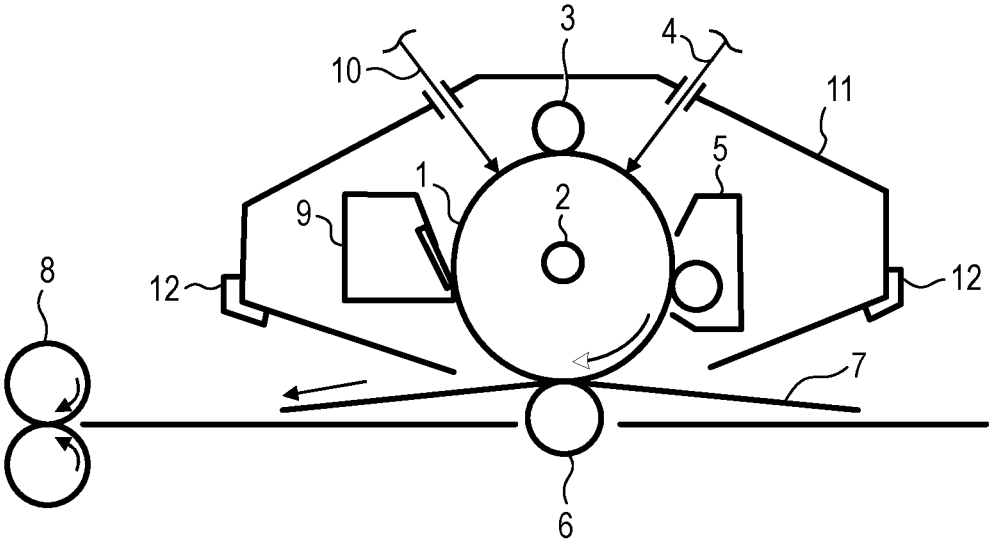
FIG. 1 illustrates a view illustrating an example of a schematic configuration of an electrophotographic apparatus provided with a process cartridge according to the present disclosure.

Preferred embodiments of the present disclosure will now be described in detail in accordance with the accompanying drawings.

In order to solve the above problems, the present disclosure includes using a combination of a toner having a metal salt of a polyvalent acid on a part of the surface of the toner particle with an electrophotographic photosensitive member of which the surface layer contains an acrylic resin or a methacrylic resin.

The present inventors guess a mechanism through which the combination of the toner satisfying such characteristics with the electrophotographic photosensitive member reduces the fogging, in the following way.

In an electrophotographic process, an image is generally formed by a method in which a toner image is formed on an electrophotographic photosensitive member and the toner image is transferred onto an intermediate transfer member or paper.

A toner having a metal salt of a polyvalent acid on a part of the surface of a toner particle tends to be easily negatively charged due to a polarization of the metal salt of the polyvalent acid, and is excellent in electrostatic properties. In addition, the metal salt of the polyvalent acid has an appropriate resistance value, and thereby the electric charge tends to easily move.

On the other hand, an electrophotographic photosensitive member containing an acrylic resin or a methacrylic resin tends to be easily charged positively compared to the toner having the metal salt of the polyvalent acid on a part of its surface.

The present inventors assume that because of this, when the toner image has been formed on the electrophotographic photosensitive member, the negative charge is supplied from the electrophotographic photosensitive member to the toner, thereby the charging uniformity of the toner is improved, and the fogging is reduced.

[Toner]

The toner in the present disclosure is a toner having a toner particle, wherein the toner particle has a metal salt of a polyvalent acid, on a part of its surface.

The metal salt of the polyvalent acid is formed by a combination of a polyvalent acid with a metal element.

The polyvalent acid may be any acid as long as the acid is divalent or polyvalent. Specific examples include the followings:

inorganic acids such as phosphoric acid, carbonic acid and sulfuric acid; and organic acids such as dicarboxylic acids and tricarboxylic acids.

Specific examples of the organic acids include the followings:

dicarboxylic acids such as oxalic acid, malonic acid, succinic acid, glutaric acid, adipic acid, fumaric acid, maleic acid, pimelic acid, suberic acid, azelaic acid, sebacic acid, phthalic acid, isophthalic acid and terephthalic acid; and tricarboxylic acids such as citric acid, aconitic acid and trimellitic acid.

Among the acids, it is preferable that the polyvalent acid contains at least one selected from the group consisting of carbonic acid, sulfuric acid and phosphoric acid which are inorganic acids, because the polyvalent acid strongly reacts with a metal element, and the metal salt of the polyvalent acid resists absorbing moisture. It is more preferable that the polyvalent acid includes phosphoric acid.

It is preferable that the metal salt of the polyvalent acid contains at least one metal element selected from the group consisting of metal elements contained in Group 3 to Group 13, as the metal element. A salt formed of a metal element contained in Group 3 to Group 13 and a polyvalent acid is low in hygroscopicity, and accordingly can stably obtain an effect of reducing the fogging even in a high humidity environment.

Specific examples of the metal elements which are used in the present disclosure include titanium, zirconium, aluminum, zinc, indium, hafnium, iron, copper, silver and the like. Among the metals, it is preferable to be a metal having a valence of 3 or more. More specifically, of these, titanium, zirconium and aluminum are more preferable; and titanium is further preferable.

Specific examples of the metal salts of the polyvalent acids, in which the above metals are combined with the above polyvalent acids, include: metal phosphates such as a titanium phosphate compound, a zirconium phosphate compound, an aluminum phosphate compound and a copper phosphate compound; metal sulfates such as a titanium sulfate compound, a zirconium sulfate compound and an aluminum sulfate compound; metal carbonates such as a titanium carbonate compound, a zirconium carbonate compound, and an aluminum carbonate compound; and metal oxalates such as a titanium oxalate compound. Among the metal salts, metal phosphates are preferable because of having high strength because the phosphate ion cross-links between metals, and being excellent in charge rising properties because of having an ionic bond in the molecule; and the titanium phosphate compound is further preferable.

The method for obtaining the above metal salts of the polyvalent acids is not particularly limited, and conventionally known methods can be used. Among the methods, such a method is preferable as to obtain a metal salt of a polyvalent acid by reacting a polyvalent acid ion with a metal compound which becomes a metal source, in an aqueous medium.

The metal sources to be used in the case of obtaining the metal salts of the polyvalent acids by the above method are not particularly limited, but conventionally known metal compounds can be used, as long as the metal compounds each give a metal salt of a polyvalent acid by a reaction with a polyvalent acid ion.

Specific examples include: metal chelates such as titanium lactate, titanium tetraacetylacetonate, titanium lactate ammonium salt, titanium triethanolaminate, zirconium lactate, zirconium lactate ammonium salt, aluminum lactate, aluminum trisacetylacetonate and copper lactate; and metal alkoxides such as titanium tetraisopropoxide, titanium ethoxide, zirconium tetraisopropoxide and aluminum trisisopropoxide. Among the metal compounds, the metal chelates are preferable because of tending to easily control the reaction and quantitatively reacting with a polyvalent acid ion. In addition, lactic acid chelates such as titanium lactate and zirconium lactate are more preferable from the viewpoint of solubility in an aqueous medium.

As a polyvalent acid ion to be used in the case of obtaining the metal salt of a polyvalent acid by the above method, ions of the above polyvalent acids can be used. As for a form of addition to the aqueous medium, a polyvalent acid itself may be added, or a water-soluble metal salt of the polyvalent acid may be added to the aqueous medium and be dissociated in the aqueous medium.

It is preferable for the number average particle size of the metal salt of the polyvalent acid to be 1 nm or larger and 400 nm or smaller, is more preferable to be 1 nm or larger and 200 nm or smaller, and is further preferable to be 1 nm or larger and 60 nm or smaller.

By the number average particle size of the metal salt of the polyvalent acid being set in the above range, the contamination of the member is suppressed, which is caused by the migration of the metal salt of the polyvalent acid from a toner to the surface of the photosensitive member or to another member. Thereby, it becomes easy to maintain the negative electrostatic properties of the toner surface and the positive electrostatic properties of the surface of the photosensitive member. Because of this, it becomes easier to obtain an effect of reducing the fogging.

A method of adjusting the number average particle size of the metal salt of the polyvalent acid to the above range includes: the amount of compounds to be added that include a polyvalent acid and a metal element which are raw materials of the fine particle; a pH at the time when the compounds react with each other, and a temperature at the time of the reaction.

In the case of obtaining toner particles by making a polyvalent acid react with a compound containing a metal element in a dispersion liquid of toner base particles, and depositing the resulting reaction product on the surface of the toner base particles, it is preferable to use an organosilicon compound together which is represented by the following Formula (T-1).

By the organosilicon compound being used together, the resulting reaction product is more firmly fixed to the toner base particles, the surface is hydrophobized, and stability in an environment is further improved.

Specifically, firstly, the organosilicon compound represented by the following Formula (T-1) is hydrolyzed previously, or is hydrolyzed in the dispersion liquid of the toner base particles.

After that, the hydrolyzate of the obtained organosilicon compound is condensed and is converted into a condensate.

The condensate migrates to the surface of the toner base particle. The condensate has viscous properties, and accordingly can bring the reaction product of the polyvalent acid and the compound containing the metal element into close contact with the surface of the toner base particle, and more firmly fix the reaction product to the toner base particle.

In addition, the condensate also migrates to the surface of the reaction product, hydrophobizes the reaction product, and can further improve the stability in the environment.

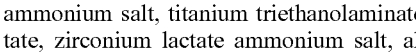

$$R_{a(n)}—Si—R_{b(4-n)} \quad \text{(T-1)}$$

In Formula (T-1), $R_a$ represents a halogen atom, a hydroxy group or an alkoxy group; $R_b$ represents an alkyl group, an alkenyl group, an aryl group, an acyl group or a methacryloxy alkyl group; and n represents an integer of 2 to 4. However, when a plurality of $R_a$ and $R_b$ exist, the substituents of the plurality of $R_a$ and the plurality of $R_b$ may be each the same or different.

As the organosilicon compounds represented by Formula (T-1), known organosilicon compounds can be used without particular limitation. Specific examples include the following silane compounds.

Examples of bifunctional silane compounds include dimethyl dimethoxysilane and dimethyl diethoxysilane.

Examples of trifunctional silane compounds include the followings:

trifunctional silane compounds each having an alkyl group as a substituent, such as methyl trimethoxysilane, methyl triethoxysilane, methyl diethoxymethoxysilane, methyl ethoxydimethoxysilane, ethyl trimethoxysilane, ethyl triethoxysilane, propyl trimethoxysilane, propyl triethoxysilane, butyl trimethoxysilane, butyl triethoxysilane, hexyl trimethoxysilane, hexyl triethoxysilane, octyl trimethoxysilane, octyl triethoxysilane, decyl trimethoxysilane and decyl triethoxysilane;

trifunctional silane compounds each having an alkenyl group as a substituent, such as vinyl trimethoxysilane, vinyl triethoxysilane, allyl trimethoxysilane and allyl triethoxysilane;

trifunctional silane compounds each having an aryl group as a substituent, such as phenyl trimethoxysilane and phenyl triethoxysilane; and trifunctional silane compounds each having a methacryloxy alkyl group as a substituent, such as γ-methacryloxy propyl trimethoxysilane, γ-methacryloxy propyl triethoxysilane, γ-methacryloxy propyl diethoxymethoxysilane and γ-methacryloxy propyl ethoxydimethoxysilane.

Examples of tetrafunctional silane compounds include tetramethoxysilane, tetraethoxysilane, tetrapropoxysilane and tetrabutoxysilane.

It is preferable for a content of the condensate of at least one organosilicon compound selected from the group consisting of organosilicon compounds represented by Formula (T-1) in the toner particles to be 0.1% by mass or more and 20.0% by mass or less, and is more preferable to be 0.5% by mass or more and 15.0% by mass or less.

A method for producing the toner base particle is not particularly limited, and known methods can be used such as a suspension polymerization method, a dissolution suspension method, an emulsion aggregation method and a pulverization method.

In the case where a reaction product of a polyvalent acid and a compound containing a metal element is made to exist on the surface of the toner base particle, and when the toner base particles are produced in an aqueous medium, the resultant may be used as is as a dispersion liquid of the toner base particles. Alternatively, after cleaning, filtration and drying, redispersion into an aqueous medium may be conducted to obtain a dispersion liquid of the toner base particles.

On the other hand, when the toner base particles re produced by a dry method, the obtained toner base particles may be dispersed in an aqueous medium by a known method to obtain a dispersion liquid of the toner base particles. In order that the toner base particles are dispersed in the aqueous medium, it is preferable that the aqueous medium contains a dispersion stabilizer.

A production example of the toner base particles using the suspension polymerization method will be specifically described below.

Firstly, a polymerizable monomer composition is prepared by mixing a polymerizable monomer which can form a binder resin with, if necessary, various additives, and dissolving or dispersing the materials using a dispersion machine.

Examples of various additives include coloring agents, waxes, charge control agents, polymerization initiators and chain transfer agents.

Examples of the dispersion machine include a homogenizer, a ball mill, a colloid mill and an ultrasonic disperser.

Next, the polymerizable monomer composition is charged into an aqueous medium which contains poorly water-soluble inorganic fine particles, and droplets of the polymerizable monomer composition are prepared using a high speed disperser such as a high speed stirrer or an ultrasonic disperser (granulation step).

After that, the polymerizable monomers in the droplets are polymerized, and toner base particles are obtained (polymerization step).

The polymerization initiator may be mixed when the polymerizable monomer composition is prepared, or may be mixed into the polymerizable monomer composition right before the droplets are formed in the aqueous medium.

In addition, the polymerization initiator may be added while the droplets are granulated or after the granulation has been completed, in other words, right before the polymerization reaction is started, if necessary, in a state of having been dissolved in the polymerizable monomer or another solvent.

After obtaining the resin particles by the polymerization of the polymerizable monomer, solvent removal treatment may be performed as needed to obtain the dispersion liquid of the toner base particles.

Examples of the binder resin include the following resins or polymers:

vinyl-based resins; polyester resins; polyamide resins; furan resins; epoxy resins; xylene resins; and silicone resins.

Among the resins, the vinyl-based resins are preferable. In addition, examples of the vinyl-based resins include polymers of the following monomers or copolymers thereof:

styrene-based monomers such as styrene and α-methylstyrene; unsaturated carboxylic acid esters such as methyl acrylate, butyl acrylate, methyl methacrylate, 2-hydroxyethyl methacrylate, t-butyl methacrylate and 2-ethylhexyl methacrylate; unsaturated carboxylic acids such as acrylic acid and methacrylic acid; unsaturated dicarboxylic acids such as maleic acid; unsaturated dicarboxylic acid anhydrides such as maleic anhydride; nitrile-based vinyl monomers such as acrylonitrile; halogen-containing vinyl monomers such as vinyl chloride; and nitro vinyl monomers such as nitrostyrene.

Among the resins, a copolymer is preferable which uses a styrene-based monomer and an unsaturated carboxylic acid ester, as monomers.

The coloring agents to be used include black pigments, yellow pigments, magenta pigments and cyan pigments, which will be described below.

Examples of the black pigments include carbon black.

Examples of the yellow pigments include: monoazo compounds; disazo compounds; condensed azo compounds; isoindolinone compounds; isoindoline compounds; benzimidazolone compounds; anthraquinone compounds; azo metal complex; methine compounds; and allylamide compounds.

Specific examples include C. I. Pigment Yellow 74, 93, 95, 109, 111, 128, 155, 174, 180 and 185.

Examples of the magenta pigments include: monoazo compounds; condensed azo compounds; diketo-pyrrolopyrrole compounds; anthraquinone compounds; quinacridone compounds; basic dye lake compounds; naphthol compounds: benzimidazolone compounds; thioindigo compounds; and perylene compounds.

Specific examples include: C. I. Pigment Red 2, 3, 5, 6, 7, 23, 48:2, 48:3, 48:4, 57:1, 81:1, 122, 144, 146, 150, 166, 169, 177, 184, 185, 202, 206, 220, 221, 238, 254 and 269; and C. I. Pigment Violet 19.

Examples of the cyan pigments include: copper phthalocyanine compounds and derivatives thereof; anthraquinone compounds; and basic dye lake compounds.

Specific examples include C. I. Pigment Blue 1, 7, 15, 15:1, 15:2, 15:3, 15:4, 60, 62 and 66.

In addition, various dyes which are conventionally known as coloring agents may be used together with the pigment.

It is preferable that a content of the coloring agent is 1.0 part by mass or more and 20.0 parts by mass or less with respect to 100 parts by mass of the binder resin.

The toner can also contain a magnetic material to be determined as a magnetic toner. In this case, the magnetic material can also serve as a coloring agent.

Examples of the magnetic materials include: iron oxides represented by magnetite, hematite, ferrite and the like; metals represented by iron, cobalt, nickel and the like; alloys between these metals and metals such as aluminum, cobalt, copper, lead, magnesium, tin, zinc, antimony, beryllium, bismuth, cadmium, calcium, manganese, selenium, titanium, tungsten and vanadium; and mixtures thereof.

Examples of the waxes include the followings:

esters between a monohydric alcohol and an aliphatic monocarboxylic acid, or esters between a monovalent carboxylic acid and an aliphatic monoalcohol, such as behenyl behenate, stearyl stearate and palmityl palmitate; esters between a dihydric alcohol and an aliphatic monocarboxylic acid, or esters between a divalent carboxylic acid and an aliphatic monoalcohol, such as di-behenyl sebacate and hexanediol dibehenate; esters between a trihydric alcohol and an aliphatic monocarboxylic acid, or esters between a trivalent carboxylic acid and an aliphatic monoalcohol, such as glycerin tribehenate; esters between a tetrahydric alcohol and an aliphatic monocarboxylic acid, or esters between a tetravalent carboxylic acid and an aliphatic monoalcohol, such as pentaerythritol tetrastearate and pentaerythritol tetrapalmitate; esters between a hexahydric alcohol and an aliphatic monocarboxylic acid, or esters between a hexavalent carboxylic acid and an aliphatic monoalcohol, such as dipentaerythritol hexastearate and dipentaerythritol hexapalmitate; esters between a polyhydric alcohol and an aliphatic monocarboxylic acid, or esters between a polycarboxylic acid and an aliphatic monoalcohol, such as polyglycerin behenate; natural ester waxes such as carnauba wax and rice wax; petroleum waxes such as paraffin wax, microcrystalline wax and petrolatum, and derivatives thereof; hydrocarbon waxes by the Fischer-Tropsch method, and derivatives thereof; polyolefin waxes such as polyethylene wax and polypropylene wax, and derivatives thereof; higher fatty alcohols; fatty acids such as stearic acid and palmitic acid; and acid amide waxes.

It is preferable that a content of the wax is 0.5 parts by mass or more and 20.0 parts by mass or less, with respect to 100 parts by mass of the binder resin.

As for the toner, various organic or inorganic fine particles may be externally added to the toner particles, to such an extent as not to impair the characteristics or effects. Examples of the organic or inorganic fine particles include the followings.

Flowability-imparting agents: silica, alumina, titanium oxide, carbon black and carbon fluoride.

Abrasives: metal oxides (for example, strontium titanate, cerium oxide, alumina, magnesium oxide and chromium oxide), nitrides (for example, silicon nitride), carbides (for example, silicon carbide), and metal salts (for example, calcium sulfate, barium sulfate and calcium carbonate).

Lubricants: fine particles of fluorine-based resins (for example, vinylidene fluoride and polytetrafluoroethylene), and fatty acid metal salts (for example, zinc stearate and calcium stearate).

Charge controllable particles: metal oxides (for example, tin oxide, titanium oxide, zinc oxide, silica and alumina), and carbon black.

The organic or inorganic fine particle may be hydrophobized. Examples of treatment agents for hydrophobizing the organic or inorganic fine particle include an unmodified silicone varnish, various modified silicone varnishes, unmodified silicone oil, various modified silicone oils, silane compounds, silane coupling agents, other organosilicon compounds and organic titanium compounds. These treatment agents may be used alone or in combination.

<Structure of Cross Section of Toner Particle>

A preferable form of the toner particle will be described below which constitutes the toner of the present disclosure, in the case where the cross section has been observed with a transmission electron microscope.

It can be checked whether or not the organosilicon polymer forms a convex portion at a position corresponding to the surface of the toner base particle, by a comparison between a cross section of the toner particle which is observed with a transmission electron microscope, and an EDX mapping image of the constituent elements in the cross section of the toner particle, which is obtained by an analysis using energy dispersive X-ray spectroscopy (EDX). In the toner particle constituting the toner of the present disclosure, when the height of the convex portion is represented by convex height H, it is preferable that the convex height H is 30 nm or higher and 300 nm or lower.

The method of calculating the convex height H will be described later.

In the toner of the present disclosure, when the metal element contained in the metal salt of the polyvalent acid is represented by a metal element M, and when a proportion of the metal element M in proportions of constituent elements on the surface of the toner particle which is determined from a spectrum obtained by the X-ray photoelectron spectroscopic analysis of the toner particle is represented by M1 (atm %), it is preferable that M1 is 1.0 (atm %) or larger and 10.0 (atm %) or smaller.

In addition, a toner obtained by dispersing 1 g of the toner in a mixed aqueous solution containing 31 g of an aqueous solution of 61.5% sucrose and 6 g of an aqueous solution of 10% neutral surfactant for cleaning a precision measuring instrument containing a nonionic surfactant and an anionic surfactant, and subjecting the dispersion liquid to treatment (a) of shaking the liquid at 300 times per minute using a shaker is determined to a toner (a). When a proportion of the metal element M in the proportions of constituent elements on the surface of the toner particle which is determined from the spectrum obtained by the X-ray photoelectron spectroscopic analysis of the toner (a) is represented by M2 (atm %), it is preferable that both of the M1 and the M2 are 1.0 (atm %) or larger and 10.0 (atm %) or smaller, and that the M1 and the M2 satisfy the following Relational Expression (ME-1).

$$0.90 \leq M2/M1 \quad \text{(ME-1)}$$

In the above treatment (a), the metal salt of a polyvalent acid can be removed, which is weakly deposited on the surface of the toner particle. Specifically, the metal salt of a polyvalent acid, which has been deposited on the toner base particle by the dry method, tends to be easily removed by the above treatment (a). Accordingly, the above treatment (a) enables the evaluation on a fixation state of the metal salt of a polyvalent acid or the organosilicon polymer, which exists on the surface of the toner particle; and the smaller the change in each parameter, which has been caused by the above treatment (a), the more firmly the metal salt of the polyvalent acid results in being fixed to the toner base particle.

The above M1 and M2 show a state of the surface of the toner particle, which is coated with the metal salt of a polyvalent acid, before and after the treatment (a), respectively. In addition, the state of the surface of the toner particle, which is coated with the metal salt of a polyvalent acid, contributes to the electrostatic properties of the toner and the mobility of an electric charge.

When both of the above M1 and M2 are in a range of 1.0 (atm %) or larger and 10.0 (atm %) or smaller, the negative electrostatic properties of the toner and the mobility of an electric charge are improved, accordingly the electric charge moves more smoothly to the toner from the electrophotographic photosensitive member, and it is easy to obtain the effect of reducing the fogging.

It is more preferable for the above M1 and M2 to be 1.0 (atm %) or larger and 7.0 (atm %) or smaller, and is further preferable to be 1.5 (atm %) or larger and 5.0 (atm %) or smaller.

The above Expression (ME-1) means a proportion of the metal salt of a polyvalent acid, which does not exfoliate from the surface of the toner particle due to the above treatment (a), but remains thereon. In the case where M2/M1 becomes 0.90 or larger, the metal salt of a polyvalent acid is firmly fixed to the surface of the toner particle, and accordingly, it is suppressed for the metal salt of the polyvalent acid to migrate from the toner to the surface of the photosensitive member. Therefore, the toner can be obtained which tends to easily maintain the negative electrostatic properties of the surface of the toner particle and the positive electrostatic properties of the surface of the photosensitive member, can stably reduce the fogging even after long-term use, and is excellent in durability.

In addition, it is more preferable that M2/M1 is 0.95 or larger.

<Method for Forming Convex Portion Containing Organosilicon Polymer>

A method for forming the convex portion on the toner particle, which contains the organosilicon polymer, is not particularly limited, and conventionally known methods can be used. Examples of the methods include: a method of condensing the compound that has been shown in the above item of the organosilicon compound, in the aqueous medium in which the toner base particles are dispersed, and forming the convex portion on the above toner base particle; and a method of depositing a convex portion containing an organosilicon polymer onto the toner base particle by a dry or wet method, by a mechanical external force.

Among these, a method of condensing the compound that has been shown in the above item of the organosilicon compound, in the aqueous medium in which the toner base particles are dispersed, and forming the convex portion on the above toner base particle, because the method can firmly fix the toner base particle and the convex portion to each other.

The above method will be described below.

In the case where the convex portion is formed on the toner base particle by the above method, it is preferable that the method includes: a step (step 1) of dispersing the toner base particles in an aqueous medium to obtain a dispersion liquid of the toner base particles; and a step (step 2) of mixing an organosilicon compound (or hydrolyzate thereof) into the above dispersion liquid of the toner base particles, subjecting the organosilicon compound to a condensation reaction in the above dispersion liquid of the toner base particles, and thereby forming a convex portion containing an organosilicon polymer, on the above toner base particle.

In the above step 1, examples of a method of obtaining the dispersion liquid of the toner base particles include: a method of directly using the dispersion liquid of the toner base particles, which has been produced in the aqueous medium; and a method of charging dried toner base particles into an aqueous medium for mechanical dispersion. In the case of dispersing the dried toner base particles in the aqueous medium, a dispersing agent may be used.

As the above dispersing agents, known dispersion stabilizers and surfactants can be used. Specifically, examples of the dispersion stabilizers include the followings: inorganic dispersion stabilizers such as tricalcium phosphate, hydroxyapatite, magnesium phosphate, zinc phosphate, aluminum phosphate, calcium carbonate, magnesium carbonate, calcium hydroxide, magnesium hydroxide, aluminum hydroxide, calcium metasilicate, calcium sulfate, barium sulfate, bentonite, silica and alumina; and organic dispersion stabilizers such as polyvinyl alcohol, gelatin, methyl cellulose, methyl hydroxypropyl cellulose, ethyl cellulose, sodium salt of carboxymethyl cellulose, and starch. In addition, examples of the surfactants include the followings: anionic surfactants such as alkyl sulfates, alkylbenzene sulfonates and fatty acid salts; nonionic surfactants such as polyoxyethylene alkyl ethers and polyoxypropylene alkyl ethers; and cationic surfactants such as alkylamine salts and quaternary ammonium salts. It is preferable for the dispersion liquid of the toner base particles to contain the inorganic dispersion stabilizer, in the surfactants, and is more preferable to contain the dispersion stabilizer which includes phosphates such as tricalcium phosphate, hydroxyapatite, magnesium phosphate, zinc phosphate and aluminum phosphate.

In the above step 2, the organosilicon compound may be added intact to the dispersion liquid of the toner base particles, or may be hydrolyzed and then be added to the dispersion liquid of the toner base particles. In particular, addition after the hydrolysis is preferable, because it is easy to control the above condensation reaction, and the amount of the organosilicon compound remaining in the dispersion liquid of the toner base particles can be reduced. It is preferable to perform the above hydrolysis in an aqueous medium of which the pH is adjusted using known acid and base. It is known that the hydrolysis of the organosilicon compound has pH dependency, and in the case where the above hydrolysis is performed, it is preferable to appropriately change the pH according to the type of the organosilicon compound. For example, when methyl triethoxysilane is used as the organosilicon compound, it is preferable that the pH of the above aqueous medium is 2.0 or higher and 6.0 or lower.

Specific examples of acids for adjusting the pH include the followings: inorganic acids such as hydrochloric acid, hydrobromic acid, hydroiodic acid, hypochlorous acid, chlorous acid, chloric acid, perchloric acid, hypobromous acid, bromous acid, bromic acid, perbromic acid, hypoiodous acid, iodous acid, iodic acid, periodic acid, sulfuric acid, nitric acid, phosphoric acid, boric acid; and organic acids such as acetic acid, citric acid, formic acid, gluconic acid, lactic acid, oxalic acid and tartaric acid.

Specific examples of bases for adjusting the pH include the followings: alkali metal hydroxides such as potassium hydroxide, sodium hydroxide and lithium hydroxide, and aqueous solutions thereof; alkali metal carbonates such as potassium carbonate, sodium carbonate and lithium carbonate, and aqueous solutions thereof; alkali metal sulfates such as potassium sulfate, sodium sulfate and lithium sulfate, and aqueous solutions thereof; alkali metal phosphates such as potassium phosphate, sodium phosphate and lithium phosphate, and aqueous solutions thereof; alkaline earth metal hydroxides such as calcium hydroxide and magnesium hydroxide, and aqueous solutions thereof; and amines such as ammonia and triethylamine.

It is preferable to control the above condensation reaction in the above step 2, by adjusting the pH of the dispersion liquid of the toner base particles. It is known that the condensation reaction of the organosilicon compound has the pH dependency, and in the case where the above condensation reaction is performed, it is preferable to appropriately change the pH according to the type of the organosilicon compound. For example, when methyl triethoxysilane is used as the organosilicon compound, it is preferable that the pH of the above aqueous medium is 6.0 or higher and 12.0 or lower. By the above pH being adjusted, the convex height H and the convex width W of the convex portion of the present disclosure can be controlled, and it becomes easier to obtain the effect of the present disclosure. Usable acids and bases for adjusting the pH include the acids and the bases of which the examples have been described in the above item of the hydrolysis.

The methods for measuring each value of physical properties will be described below.

<Method for Measuring Weight Average Particle Size (D4) and Number Average Particle Size (D1) of Toner Particles>

The weight average particle size (D4) and number average particle size (D1) of toner particles are calculated in the following way.

As a measuring apparatus, a precision particle size distribution measuring apparatus "Coulter Counter Multisizer 3" (registered trademark, manufactured by Beckman Coulter, Inc.) is used which is equipped with an aperture tube of 100 μm and adopts a pore electrical resistance method. For setting of measurement conditions and analysis of measurement data, an attached dedicated software is used which is "Beckman Coulter Multisizer3 Version 3.51" (manufactured by Beckman Coulter, Inc.). In the measurement, the number of effective measurement channels is set at 25000.

As an electrolytic aqueous solution to be used for the measurement, the solution, for example, "ISOTON II" (trade name) (produced by Beckman Coulter, Inc.) can be used, which has been prepared by dissolving sodium chloride of a special grade in ion-exchanged water so that the concentration becomes 1.0%.

In addition, before starting the measurement and the analysis, the dedicated software is set in the following way.

On a screen of "Change standard measurement method (SOMME)" in the dedicated software, the total count number of a control mode is set at 50,000 particles, the number of measurement times is set at one time, and the Kd value is set at a value which is obtained using "standard particle 10.0 μm" (trade name) (manufactured by Beckman Coulter, Inc.).

A threshold value and a noise level are automatically set by pressing "button for measuring threshold value/noise level". In addition, the current is set at 1,600 μA, the gain is set at 2, and the electrolytic aqueous solution is set at ISOTON II; and a checkmark is placed in "Flash of aperture tube after measurement".

On a screen of "Setting of conversion from pulse to particle size" in the dedicated software, a bin interval is set at a logarithmic particle size, a particle size bin is set at 256 particle size bin, and the particle size range is set at 2 μm to 60 μm.

The specific measuring method is as follows.

(1) Charge 200.0 mL of the electrolytic aqueous solution in a 250 mL round-bottom beaker made from glass, which is dedicated to Multisizer 3, set the beaker on a sample stand, and stir the stirrer rod counterclockwise at 24 rotation per second. In addition, remove dirts and air bubbles inside the aperture tube beforehand by a "flush of aperture tube" function of the dedicated software.

(2) Charge 30.0 mL of the electrolytic aqueous solution in a 100 mL flat-bottom beaker made from glass. Into the flat-bottom beaker, add 0.3 mL of a diluted solution as a dispersant, which has been prepared by diluting "Contaminon N" (trade name) (aqueous solution of 10% neutral surfactant having a pH of 7 for washing precision measuring instruments, which includes nonionic surfactant, anionic surfactant and organic builder, produced by Fujifilm Wako Pure Chemical Corporation) by ion-exchanged water into 3 times by mass.

(3) Prepare an ultrasonic disperser "Ultrasonic Dispersion System Tetra 150" (trade name) (manufactured by Nikkaki Bios Co., Ltd.), which has two oscillators having an oscillation frequency of 50 kHz in such a state that the phases deviate 180° from each other, and has an electric output of 120 W. Charge 3.3 L of ion-exchanged water into a water tank of the ultrasonic disperser, and add 2.0 mL of Contaminon N (trade mark) into this water tank.

(4) Set the beaker of (2) in a hole of the ultrasonic disperser, for fixing the beaker, and operate the ultrasonic disperser. Then, adjust a height position of the beaker so that a resonance state of a liquid surface of the electrolytic aqueous solution in the beaker becomes maximum.

(5) Add 10 mg of the toner particles into the electrolytic aqueous solution little by little, in a state in which the electrolytic aqueous solution in the beaker of the (4) is irradiated with ultrasonic waves, and disperse the toner particles. Then, continue the ultrasonic dispersion treatment for another 60 seconds. In addition, in the ultrasonic dispersion, appropriately adjust a water temperature in the water tank so as to be 10° C. or higher and 40° C. or lower.

(6) Add the electrolytic aqueous solution of (5) dropwise in which the toner particles are dispersed, into the round-bottom beaker of (1) installed in the sample stand using a pipette, and adjust the measured concentration so as to become 5%. Then, continue the measurement until the number of measured particles reaches 50,000 particles.

(7) Analyze the measurement data by the dedicated software attached to the apparatus, and calculate the weight average particle size (D4) and the number average particle size (D1). For information, an "average size" on a screen of "Analysis/statistical value (arithmetic mean) of volume" at the time when the graph/volume % has been set in the dedicated software is the weight average particle size (D4), and the "average size" on a screen of "Analysis/statistical value (arithmetic mean) of number" at the time when the graph/number % has been set in the dedicated software is the number average particle size (D1).

[Electrophotographic Photosensitive Member]

The electrophotographic photosensitive member of the present disclosure includes that the surface layer contains an acrylic resin or a methacrylic resin.

Examples of a method for manufacturing the electrophotographic photosensitive member of the present disclosure include a method of: preparing coating liquids for each layer, which will be described later; applying the coating liquids in order of desired layers, respectively; and drying the coating liquids. Examples of application methods of the coating liquid at this time include dip coating, spray coating, ink jet coating, roll coating, die coating, blade coating, curtain coating, wire bar coating and ring coating. Among the methods, the dip coating is preferable from the viewpoints of efficiency and productivity.

A support and each layer will be described below.

<Support>

In the present disclosure, the electrophotographic photosensitive member has the support. In the present disclosure, it is preferable that the support is an electroconductive support having electroconductivity. In addition, examples of the shapes of the support include a cylindrical shape, a belt shape and a sheet shape. Among the supports, the cylindrical support is preferable. In addition, the surface of the support may be subjected to electrochemical treatment such as anodization, blast treatment, cutting treatment and the like.

As a material of the support, a metal, a resin, glass and the like are preferable.

Examples of the metals include aluminum, iron, nickel, copper, gold, stainless steel, and alloys thereof. Among the metals, an aluminum support using aluminum is preferable.

In addition, the electroconductivity may be imparted to the resin or the glass by treatment such as mixing of or coating with an electroconductive material.

<Electroconductive Layer>

In the present disclosure, an electroconductive layer may be provided on the support. By the electroconductive layer being provided, the support can conceal scratches and irregularities on its surface and can control the reflection of light on its surface.

It is preferable that the electroconductive layer contains an electroconductive particle and a resin.

Examples of the material for the electroconductive particle include metal oxides, metals and carbon black.

Examples of the metal oxides include zinc oxide, aluminum oxide, indium oxide, silicon oxide, zirconium oxide, tin oxide, titanium oxide, magnesium oxide, antimony oxide and bismuth oxide. Examples of the metals include aluminum, nickel, iron, nichrome, copper, zinc and silver.

Among the materials, it is preferable to use a metal oxide as the electroconductive particle, and in particular, it is more preferable to use titanium oxide, tin oxide or zinc oxide.

When the metal oxide is used as the electroconductive particle, the surface of the metal oxide may be treated with a silane coupling agent or the like, or the metal oxide may be doped with an element such as phosphorus, aluminum or niobium, or an oxide thereof.

The electroconductive particle may have a multilayered structure having a core material particle and a covering layer with which the particle is covered. Examples of the core material particle include titanium oxide, barium sulfate and zinc oxide. Examples of the covering layer include metal oxides such as tin oxide and titanium oxide.

When the metal oxide is used as the electroconductive particle, the volume average particle size is preferably 1 nm or larger and 500 nm or smaller, and is more preferably 3 nm or larger and 400 nm or smaller.

Examples of the resins include a polyester resin, a polycarbonate resin, a polyvinyl acetal resin, an acrylic resin, a silicone resin, an epoxy resin, a melamine resin, a polyurethane resin, a phenol resin and an alkyd resin.

The electroconductive layer may further contain a concealing agent such as a silicone oil, a resin particle and titanium oxide.

It is preferable for the average film thickness of the electroconductive layer to be 1 μm or larger and 50 μm or smaller, and is particularly preferable to be 3 μm or larger and 40 μm or smaller.

The electroconductive layer can be formed by preparing a coating liquid for the electroconductive layer, which contains each of the above materials and a solvent, forming a coating film of the coating liquid, and drying the coating film. Examples of the solvent to be used for the coating liquid include an alcohol-based solvent, a sulfoxide-based solvent, a ketone-based solvent, an ether-based solvent, an ester-based solvent and an aromatic hydrocarbon-based solvent. Examples of dispersion methods for dispersing the electroconductive particles in the coating liquid for the electroconductive layer include a method using a paint shaker, a sand mill, a ball mill, or a liquid collision type high speed disperser.

<Undercoat Layer>

In the present disclosure, an undercoat layer may be provided on the support or the electroconductive layer. The undercoat layer which has been provided can thereby enhance an adhesion function between layers and impart a charge injection inhibition function.

It is preferable that the undercoat layer contains a resin. In addition, the undercoat layer may be formed as a cured film by polymerization of a composition which contains a monomer having a polymerizable functional group.

Examples of the resin include a polyester resin, a polycarbonate resin, a polyvinyl acetal resin, an acrylic resin, an epoxy resin, a melamine resin, a polyurethane resin, a phenol resin, a polyvinyl phenol resin, an alkyd resin, a polyvinyl alcohol resin, a polyethylene oxide resin, a polypropylene oxide resin, a polyamide resin, a polyamic acid resin, a polyimide resin, a polyamide imide resin and a cellulose resin.

Examples of the polymerizable functional group which the monomer having the polymerizable functional group has include an isocyanate group, a blocked isocyanate group, a methylol group, an alkylated methylol group, an epoxy group, a metal alkoxide group, a hydroxyl group, an amino group, a carboxyl group, a thiol group, a carboxylic acid anhydride group and a carbon-carbon double bond group.

The undercoat layer may further contain an electron transport substance, a metal oxide, a metal, an electroconductive polymer and the like, for the purpose of enhancing the electric characteristics. Among the materials, it is preferable to use the electron transport substance and the metal oxide.

Examples of the electron transport substance include a quinone compound, an imide compound, a benzimidazole compound, a cyclopentadienylidene compound, a fluorenone compound, a xanthone compound, a benzophenone compound, a cyanovinyl compound, a halogenated aryl compound, a silole compound and a boron-containing compound. The undercoat layer may be formed as a cured film by using an electron transport substance having a polymerizable functional group as the electron transport substance, and copolymerizing the electron transport substance with a monomer having the above polymerizable functional group.

Examples of the metal oxide include indium tin oxide, tin oxide, indium oxide, titanium oxide, zinc oxide, aluminum oxide and silicon dioxide. Examples of the metal include gold, silver and aluminum.

The surface of the metal oxide may be treated with a silane coupling agent or the like, or the metal oxide may be doped with an element such as phosphorus, aluminum or niobium, or an oxide thereof.

In addition, the undercoat layer may also further contain an additive.

It is preferable for an average film thickness of the undercoat layer to be 0.1 μm or larger and 50 μm or smaller, is more preferable to be 0.2 μm or larger and 40 μm or smaller, and is particularly preferable to be 0.3 μm or larger and 30 μm or smaller.

The undercoat layer can be formed by an operation of preparing a coating liquid for the undercoat layer containing each of the above materials and a solvent, forming a coating film of the coating liquid, and drying and/or curing the coating film. Examples of the solvent to be used for the coating liquid include an alcohol-based solvent, a ketone-based solvent, an ether-based solvent, an ester-based solvent and an aromatic hydrocarbon-based solvent.

<Photosensitive Layer>

The photosensitive layer of the electrophotographic photosensitive member is mainly classified into (1) a multilayer type photosensitive layer, and (2) a monolayer type photosensitive layer. The multilayer type photosensitive layer (1) has a charge generation layer containing a charge generation substance, and a charge transport layer containing a charge transport substance. (2) The monolayer type photosensitive layer has a photosensitive layer which contains both of the charge generation substance and the charge transport substance.

(1) Multilayer Type Photosensitive Layer

The multilayer type photosensitive layer includes the charge generation layer and the charge transport layer.

(1-1) Charge Generation Layer

It is preferable that the charge generation layer contains the charge generation substance and a resin.

Examples of the charge generation substance include an azo pigment, a perylene pigment, a polycyclic quinone pigment, an indigo pigment and a phthalocyanine pigment. Among the pigments, the azo pigment and the phthalocyanine pigment are preferable. Among the phthalocyanine pigments, oxytitanium phthalocyanine pigment, chlorogallium phthalocyanine pigment and hydroxygallium phthalocyanine pigment are preferable.

It is preferable for a content of the charge generation substance in the charge generation layer to be 40% by mass or more and 85% by mass or less, and is more preferable to be 60% by mass or more and 80% by mass or less, with respect to a total mass of the charge generation layer.

Examples of the resin include a polyester resin, a polycarbonate resin, a polyvinyl acetal resin, a polyvinyl butyral resin, an acrylic resin, a silicone resin, an epoxy resin, a melamine resin, a polyurethane resin, a phenol resin, a polyvinyl alcohol resin, a cellulose resin, a polystyrene resin, a polyvinyl acetate resin and a polyvinyl chloride resin. Among the resins, the polyvinyl butyral resin is more preferable.

In addition, the charge generation layer may further contain additives such as an antioxidizing agent and an ultraviolet absorbing agent. Specific examples include a hindered phenol compound, a hindered amine compound, a sulfur compound, a phosphorus compound and a benzophenone compound.

It is preferable for the average film thickness of the charge generation layer to be 0.1 μm or larger and 1 μm or smaller, and is more preferable to be 0.15 μm or larger and 0.4 μm or smaller.

The charge generation layer can be formed by an operation of: preparing a coating liquid for the charge generation layer, which contains each of the above materials and a solvent; forming a coating film of the coating liquid; and drying the coating film. Examples of the solvent to be used for the coating liquid include an alcohol-based solvent, a sulfoxide-based solvent, a ketone-based solvent, an ether-based solvent, an ester-based solvent and an aromatic hydrocarbon-based solvent.

(1-2) Charge Transport Layer

It is preferable that a charge transport layer contains a charge transport substance and a resin.

Examples of the charge transport substance include a polycyclic aromatic compound, a heterocyclic compound, a hydrazone compound, a styryl compound, an enamine compound, a benzidine compound, a triarylamine compound, and resins having a group derived from these substances. Among the substances, the triarylamine compound and the benzidine compound are preferable.

It is preferable for a content of the charge transport substance in the charge transport layer to be 25% by mass or more and 70% by mass or less, and is more preferable to be 30% by mass or more and 55% by mass or less, with respect to the total mass of the charge transport layer.

Examples of the resin include a polyester resin, a polycarbonate resin, an acrylic resin and a polystyrene resin. Among the resins, the polycarbonate resin and the polyester resin are preferable. In the polyester resins, a polyarylate resin is particularly preferable.

A content ratio (mass ratio) between the charge transport substance and the resin is preferably 4:10 to 20:10, and is more preferably 5:10 to 12:10.

In addition, the charge transport layer may contain additives such as an antioxidizing agent, an ultraviolet absorbing agent, a plasticizing agent, a leveling agent, a slipperiness imparting agent and an abrasion resistance improver. The specific examples include a hindered phenol compound, a hindered amine compound, a sulfur compound, a phosphorus compound, a benzophenone compound, a siloxane modified resin, silicone oil, a fluorocarbon resin particle, a polystyrene resin particle, a polyethylene resin particle, a silica particle, an alumina particle and a boron nitride particle.

It is preferable for an average film thickness of the charge transport layer to be 5 μm or larger and 50 μm or smaller, is more preferable to be 8 μm or larger and 40 μm or smaller, and is particularly preferable to be 10 μm or larger and 17 μm or smaller.

The charge transport layer can be formed by an operation of: preparing a coating liquid for the charge transport layer, which contains each of the above materials and a solvent; forming a coating film of the coating liquid; and drying the coating film. Examples of the solvent to be used for the coating liquid include an alcohol-based solvent, a ketone-based solvent, an ether-based solvent, an ester-based solvent, and an aromatic hydrocarbon-based solvent. Among these solvents, the ether-based solvent or the aromatic hydrocarbon-based solvent is preferable.

(2) Monolayer Type Photosensitive Layer

The monolayer type photosensitive layer can be formed by an operation of: preparing a coating liquid for the photosensitive layer containing a charge generation substance, a charge transport substance, a resin and a solvent; forming the coating film of the coating liquid; and drying the coating film. The charge generation substance, the charge transport substance and the resin are the same as the examples of the materials in the above "(1) multilayer type photosensitive layer".

<Surface Layer>

In the present disclosure, the surface layer includes an acrylic resin or a methacrylic resin.

It is preferable that a content of the acrylic resin or the methacrylic resin is 30% by mass or more with respect to the surface layer of the electrophotographic photosensitive member.

The acrylic resin or the methacrylic resin of the surface layer may be a cured film or may be particulate, but it is preferable to be formed as a cured film by polymerization of a composition containing a monomer having an acrylic group or a methacrylic group. Examples of the reaction at this time include a thermal polymerization reaction, a photopolymerization reaction, and a radiation-induced polymerization reaction.

Examples of the polymerizable functional group which the monomer having a polymerizable functional group has include an acryl group and a methacryl group. As a monomer having the polymerizable functional group, a material having charge transport capability may be used.

It is preferable that the acrylic resin or the methacrylic resin has a structure represented by Formula (A):

(A)

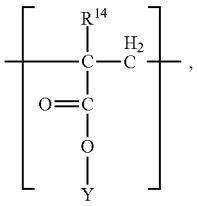

wherein $R^{14}$ represents a hydrogen atom or a methyl group, and Y represents a group having a triarylamine structure.

It is assumed that the acrylic resin or the methacrylic resin has a triarylamine structure in the side chain, thereby the conjugation spreads and enables the electric charge to efficiently transfer to and from a toner having a metal salt of a polyvalent acid on the surface.

Furthermore, it is preferable that the structure represented by Formula (A) is either one of a structure represented by the following Formula (A-1) or a structure represented by the following Formula (A-2).

(A-1)

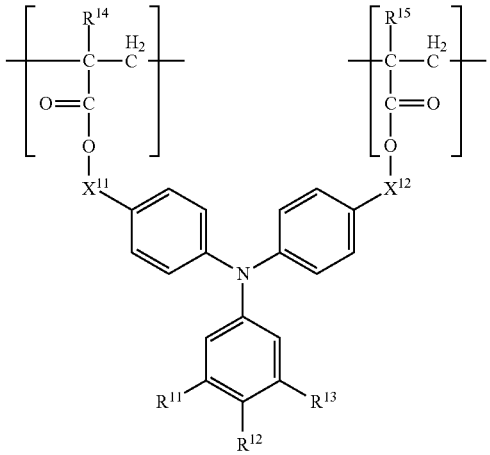

(In Formula (A-1), $R^{11}$ to $R^{15}$ each represent a hydrogen atom or a methyl group; and $X^{11}$ and $X^{12}$ each represent an alkylene group having 2 to 5 carbon atoms or a phenylene group.)

(A-2)

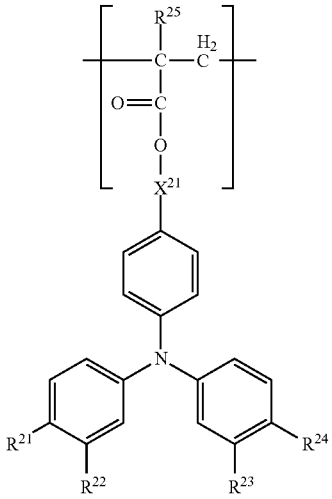

(In Formula (A-2), $R^{21}$ to $R^{25}$ each represent a hydrogen atom or a methyl group; and $X^{21}$ represents an alkylene group having 2 to 5 carbon atoms or a phenylene group.)

Examples of the monomer having a polymerizable functional group for forming the resin having the structure represented by Formula (A) include the following compounds.

(Examples of Compounds Represented by Formula (A-1))
(A-1-1)
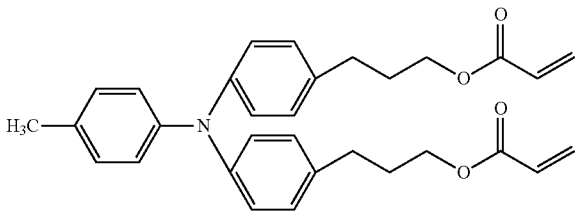
(A-1-2)
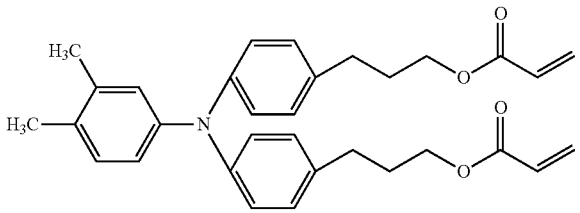
(A-1-3)
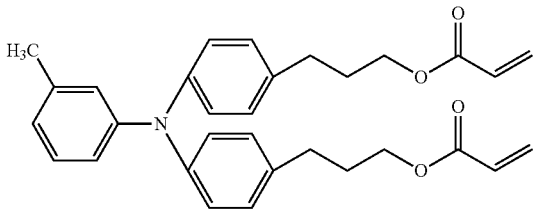
(A-1-4)
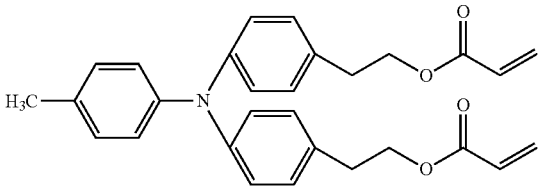
(A-1-5)
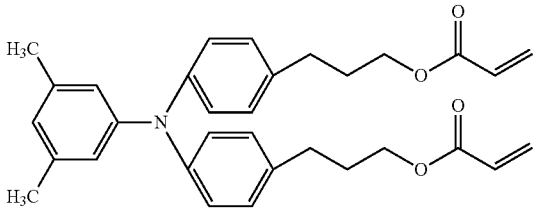
(A-1-6)
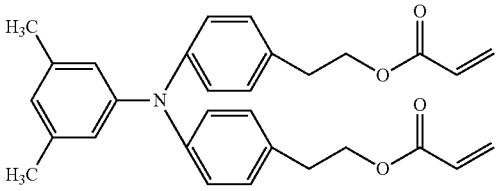
(Examples of Compounds Represented by Formula (A-2))
(A-2-1)
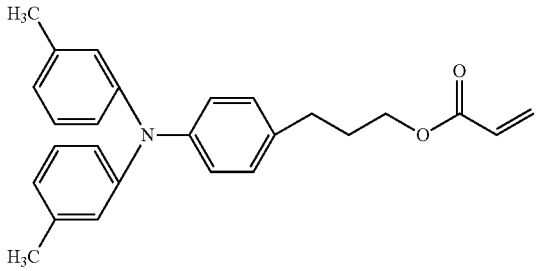
(A-2-2)
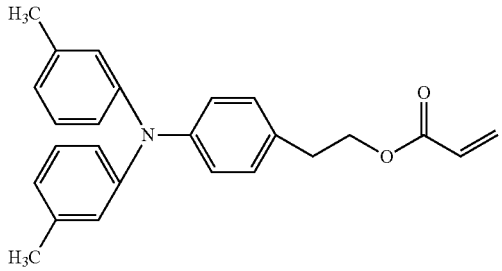
(A-2-3)
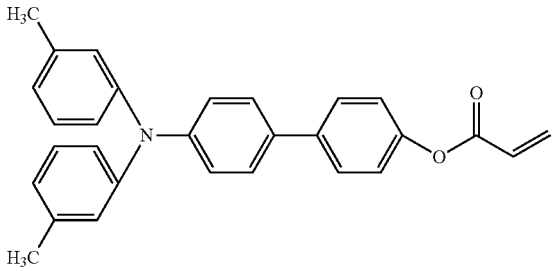
(A-2-4)
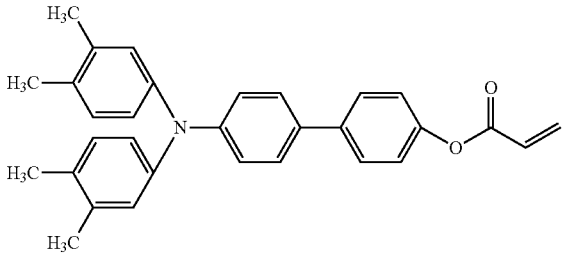
(A-2-5)
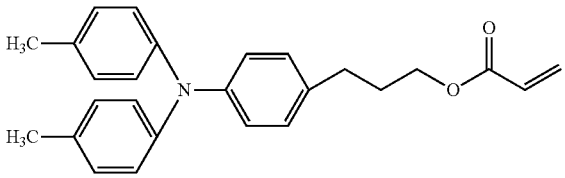
(A-2-6)
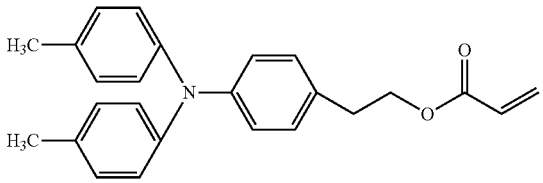

-continued (A-2-7)

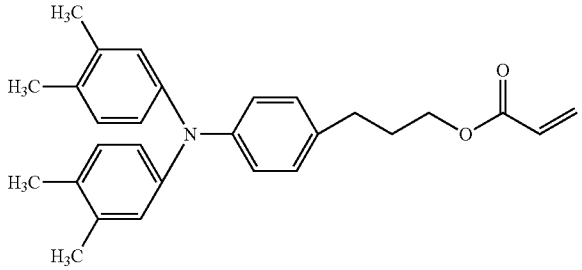

(A-2-8)

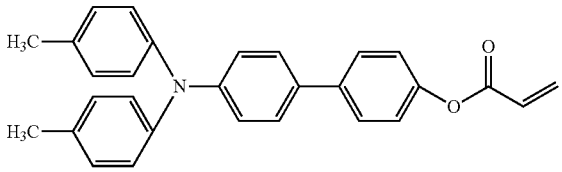

It is preferable that the total ratio of the structural units of Formula (A-1) and Formula (A-2) in the surface layer is 30% by mass or more, because the effect of the present disclosure can be further enhanced. In addition, it is more preferable that a ratio of the structural unit of Formula (A-2) to the structural unit of Formula (A-1) is 20% by mass or more and 70% by mass or less, for a proper crosslinking density and a proper arrangement of the electron transport structure.

The surface layer may contain additives such as an antioxidizing agent, an ultraviolet absorbing agent, a plasticizing agent, a leveling agent, a slipperiness imparting agent and an abrasion resistance improver. The specific examples include a hindered phenol compound, a hindered amine compound, a sulfur compound, a phosphorus compound, a benzophenone compound, a siloxane modified resin, silicone oil, a fluorocarbon resin particle, a polystyrene resin particle, a polyethylene resin particle, a silica particle, an alumina particle and a boron nitride particle.

It is more preferable that the acrylic resin or the methacrylic resin of the surface layer has a structure represented by any of the following general Formula (B-1) or (B-2).

(B-1)

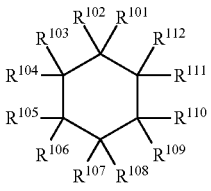

(In general Formula (B-1), in $R^{101}$ to $R^{112}$, at least two of $R^{101}$, $R^{105}$ and $R^{109}$ have a structure represented by the following general Formula (B-3); and the remaining substituents each represent a hydrogen atom or a methyl group.)

(B-2)

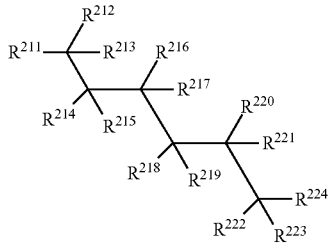

(In general Formula (B-2), in $R^{211}$ to $R^{224}$, $R^{211}$ and $R^{224}$ have a structure represented by the following general Formula (B-3); and the remaining substituents are each a hydrogen atom or a methyl group.)

(B-3)

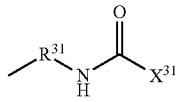

(In general Formula (B-3), $R^{31}$ represents a single bond or a methylene group optionally having a substituent; $X^{31}$ shows having a bond; and $X^{31}$ contains a structure represented by the following general Formula (B-4).)

(B-4)

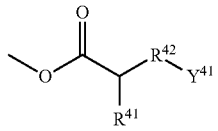

(In general Formula (B-4), $R^{41}$ represents a hydrogen atom or a methyl group, $R^{42}$ represents a methylene group; and $Y^{41}$ shows having a bond.)

Examples of the monomer having the polymerizable functional group for forming the resin having the structure represented by Formula (B-1) or (B-2) include the following compounds.

(B-1-1)

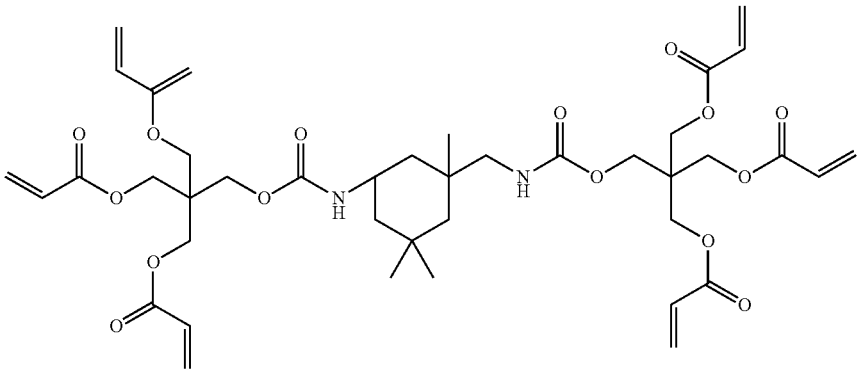

(B-1-2)

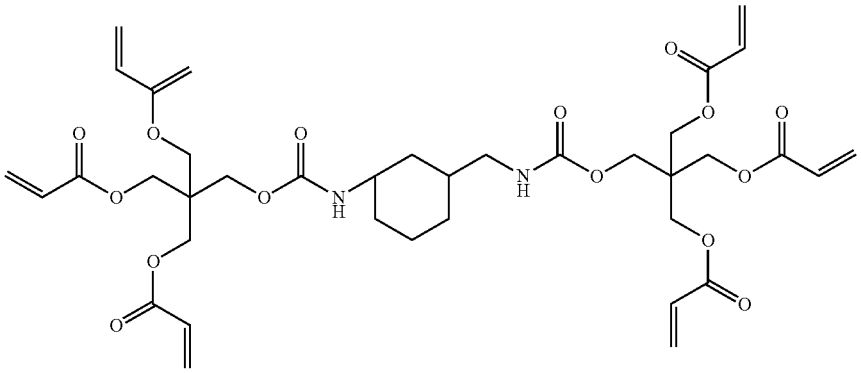

(B-1-3)

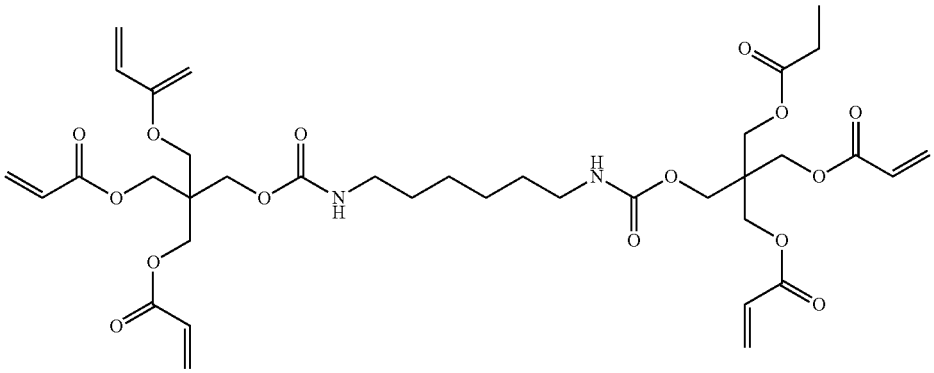

(B-1-4)

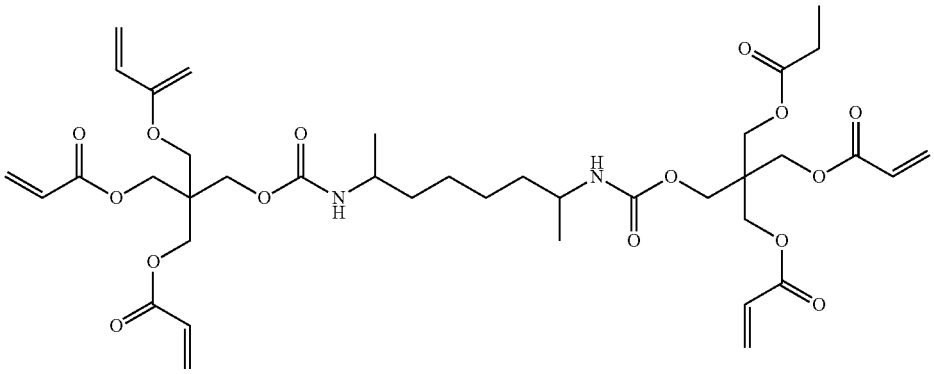

In particular, it is preferable to have a structure represented by Formula (B-1-1).

The surface layer can be formed by an operation of: preparing a coating liquid for the surface layer containing each of the above materials and a solvent; forming a coating film of the coating liquid; and drying and/or curing the coating film. Examples of the solvent to be used for the coating liquid include an alcohol-based solvent, a ketone-based solvent, an ether-based solvent, a sulfoxide-based solvent, an ester-based solvent and an aromatic hydrocarbon-based solvent.

The surface layer may contain an electroconductive particle and/or a charge transport substance, and a resin.

Examples of the electroconductive particle include particles of metal oxides such as titanium oxide, zinc oxide, tin oxide and indium oxide.

Examples of the charge transport substance include a polycyclic aromatic compound, a heterocyclic compound, a hydrazone compound, a styryl compound, an enamine compound, a benzidine compound, a triarylamine compound, and resins having a group derived from these substances. Among these substances, the triarylamine compound and the benzidine compound are preferable.

Examples of the resin include a polyester resin, an acrylic resin, a phenoxy resin, a polycarbonate resin, a polystyrene resin, a phenol resin, a melamine resin and an epoxy resin.

The surface layer can be formed by an operation of: preparing a coating liquid for the surface layer containing each of the above materials and a solvent; forming a coating film of the coating liquid; and drying and/or curing the coating film. Examples of the solvent to be used for the coating liquid include an alcohol-based solvent, a ketone-based solvent, an ether-based solvent, a sulfoxide-based solvent, an ester-based solvent and an aromatic hydrocarbon-based solvent.

It is preferable for an average film thickness of the surface layer to be 0.5 μm or larger and 10 μm or smaller, and is preferable to be 1 μm or larger and 3 μm or smaller.

It is preferable for the surface layer to have a shape in a range of $R_a$=0.010 μm or larger and 0.045 μm or smaller and Sm=0.005 mm or larger and 0.060 mm or smaller.

Here, $R_a$ is the arithmetic average roughness measured by sweep in the circumferential direction, and Sm is the average spacing measured by sweep in the circumferential direction. Furthermore, it is more preferable for the surface layer of the electrophotographic photosensitive member to have a shape in a range of $R_a$=0.010 μm or larger and 0.030 μm or smaller and Sm=0.005 mm or larger and 0.060 mm or smaller. By having the roughness in the range, the surface layer increases its contact area, and improves the efficiency of charge transfer to and from the toner having the metal salt of a polyvalent acid on the surface.

When the roughness of the surface layer of the electrophotographic photosensitive member satisfies the above range, the high effect can be obtained, but it is more preferable that the surface layer of the electrophotographic photosensitive member has a groove shape in the generatrix direction of the peripheral surface. One example of a unit for roughening the surface layer includes polishing using a polishing sheet. The polishing sheet is a sheet-shaped polishing member which is formed of a sheet substrate having such a layer thereon that polishing particles are dispersed in a binder resin. The surface of the surface layer can be roughened so as to have the groove shape, by an operation of feeding the sheet in a state in which the polishing sheet is pressed against the surface of the surface layer. The detailed surface roughening method will be described later.

It is preferable that a relationship between the shape $R_a$ of the surface layer of the electrophotographic photosensitive member and the convex height H of the toner satisfies the following relational Expression (TR-1).

$$\text{Toner convex height } H \times 0.1 < R_a \text{ of electrophotographic photosensitive member surface} < \text{toner convex height } H \quad \text{(TR-1)}$$

[Process Cartridge and Electrophotographic Apparatus]

A process cartridge of the present disclosure is characterized in that the process cartridge has a developing unit containing the toner and the electrophotographic photosensitive member described above, and is configured to be detachably attachable to a main body of the electrophotographic apparatus.

In addition, an electrophotographic apparatus of the present disclosure includes; the toner described above; a developer carrier for conveying the toner; and the electrophotographic photosensitive member.

FIG. 1 illustrates an example of a schematic configuration of an electrophotographic apparatus that has a process cartridge provided with an electrophotographic photosensitive member.

Reference numeral 1 denotes a cylindrical electrophotographic photosensitive member which is rotationally driven around a shaft 2 in a direction of an arrow at a predetermined circumferential velocity. The surface of the electrophotographic photosensitive member 1 is charged to a predetermined positive or negative potential by a charging unit 3. For information, in the figure, a roller charging system by a roller type charging member is illustrated, but a charging system such as a corona charging system, a proximity charging system or an injection charging system may also be adopted. The surface of the charged electrophotographic photosensitive member 1 is irradiated with exposure light 4 emitted from an exposure unit (not illustrated), and an electrostatic latent image corresponding to objective image information is formed on the surface. The electrostatic latent image formed on the surface of the electrophotographic photosensitive member 1 is developed by a toner accommodated in a developing unit 5, and a toner image is formed on the surface of the electrophotographic photosensitive member 1. The toner image formed on the surface of the electrophotographic photosensitive member 1 is transferred onto a transfer material 7 by a transfer unit 6. The transfer material 7 to which the toner image has been transferred is conveyed to a fixing unit 8, is subjected to fixing treatment of the toner image, and is printed out to the outside of the electrophotographic apparatus. The electrophotographic apparatus may have a cleaning unit 9 for removing an adherent such as a toner remaining on the surface of the electrophotographic photosensitive member 1 after transferring. Alternatively, a cleaning unit may not be separately provided, but a so-called cleaner-less system may be used that removes the above adherent by a developing unit or the like. The electrophotographic apparatus may have a diselectrification mechanism that subjects the surface of the electrophotographic photosensitive member 1 to a diselectrification process by pre-exposure light 10 emitted from a pre-exposure unit (not illustrated). In addition, a guide unit 12 such as a rail may also be provided in order to detachably attach the process cartridge of the present disclosure to the main body of the electrophotographic apparatus.

The electrophotographic photosensitive member of the present disclosure can be used in a laser beam printer, an LED printer, a copying machine and the like.

EXAMPLES

The present disclosure will be specifically described with reference to the following Examples. However, these Examples do not limit the invention in any way. The toner and a method for producing the toner will be described below. The term "part(s)" and "%" in Examples and Comparative Examples are all based on mass, unless there is particular notice.

<Production Example of Dispersion Liquid of Toner Base Particle>

(Preparation of Aqueous Medium)

Into a reaction vessel into which 390.0 parts of ion-exchanged water were charged, 11.2 parts of sodium phosphate (12 hydrate) were charged, and an aqueous solution of sodium phosphate was prepared, and was kept warm at 65° C. for 1.0 hour with nitrogen purge. The aqueous solution of sodium phosphate was stirred at 12,000 rpm using a stirring apparatus (trade name: T.K. Homo Mixer, manufactured by Primix Corporation). While the stirring was maintained, an aqueous solution of calcium chloride, which was prepared by dissolving 7.4 parts of calcium chloride (dihydrate) in 10.0 parts of ion-exchanged water, was charged into the reaction vessel at one time, and an aqueous medium was prepared which contained a dispersion stabilizer. Furthermore, 1.0 mol/L hydrochloric acid was added to the aqueous medium in the reaction vessel, the pH was adjusted to 6.0, and the aqueous medium was prepared.

(Preparation of Polymerizable Monomer Composition)

| | |
|---|---|
| Styrene | 60.0 parts |
| C. I. Pigment Blue 15:3 | 6.3 parts |

The above materials were charged into an attritor (manufactured by Nippon Coke & Engineering. Co., Ltd.), and were further dispersed for 5.0 hours at 220 rpm using zirconia particles having a diameter of 1.7 mm; and a coloring agent dispersion liquid in which the pigment was dispersed was prepared.

Next, the following materials were added to the coloring agent dispersion liquid.

| | |
|---|---|
| Styrene | 10.0 parts |
| N-butyl acrylate | 30.0 parts |
| Polyester resin (Condensation polymer of terephthalic acid and 2 mol adduct of propylene oxide on bisphenol A, weight average molecular weight Mw = 10,000, and acid value: 8.2 mgKOH/g) | 5.0 parts |
| HNP9 (paraffin wax, melting point: 76° C., produced by Nippon Seiro Co., Ltd.) | 6.0 parts |

The above materials were kept warm at 65° C., and were uniformly dissolved and dispersed at 500 rpm using a stirring apparatus; and a polymerizable monomer composition was prepared.

(Granulation Process)

The polymerizable monomer composition was charged into the aqueous medium, while the temperature of the aqueous medium was kept at 70° C. and the number of revolutions of the stirring apparatus was kept at 12,000 rpm, and 8.0 parts of t-butyl peroxypivalate was added thereto which was a polymerization initiator. In the state, the resultant liquid was subjected to granulation for 10 minutes while the stirring of 12,000 rpm was maintained by the stirring apparatus.

(Polymerization Process)

The stirring apparatus was changed to a stirring machine equipped with a propeller stirring blade, and the mixture liquid was subjected to polymerization while being stirred at 200 rpm and kept at 70° C. for 5.0 hours; and furthermore, was heated to 85° C., and heating was kept for 2.0 hours to be subjected to a polymerization reaction. Furthermore, the resultant liquid was heated to 98° C. and heating was kept for 3.0 hours, and thereby the remaining monomer was removed; then, ion-exchanged water was added to the liquid, and the concentration of the toner base particle in the dispersion liquid was adjusted so as to become 30.0%; and a dispersion liquid of the toner base particles was obtained in which the toner base particles were dispersed.

The number average particle size (D1) of the toner base particles was 6.2 μm, and the weight average particle size (D4) thereof was 6.9 μm.

<Production Example of Liquid of Organosilicon Compound>

| | |
|---|---|
| Ion-exchanged water | 70.0 parts |
| Methyltriethoxysilane | 30.0 parts |

The above materials were weighed in a 200 mL beaker, and the pH was adjusted to 3.5 with 10% hydrochloric acid. After that, the mixture was stirred for 1.0 hour while being heated to 60° C. in a water bath, and a liquid of the organosilicon compound was produced.

<Production Example of Fine Particle of Metal Salt of Polyvalent Acid>

| | |
|---|---|
| Ion-exchanged water | 100.0 parts |
| Sodium phosphate (12 hydrate) | 8.5 parts |

The above materials were mixed, and then while the mixture was stirred at room temperature, at 10,000 rpm using a stirring apparatus (trade name: T.K. Homo Mixer, manufactured by Primix Corporation), 60.0 parts of zirconium lactate ammonium salt (trade name: ZC-300, Matsumoto Fine Chemical Co., Ltd.) were added (which corresponded to 7.2 parts of zirconium lactate ammonium salt). To a reaction solution, 1.0 mol/L hydrochloric acid was added so that the pH of the mixture was adjusted to 7.0. The temperature of the reaction solution was adjusted to 25° C., and the reaction solution was subjected to a reaction for 1 hour while the stirring was maintained.

After that, the solid content was taken out by centrifugation separation. Subsequently, a process of redispersion in ion-exchanged water and taking out the solid content by centrifugation separation was repeated 3 times, and ions such as sodium were removed. The resultant solid content was dispersed in ion-exchanged water again, and was dried by spray drying; and fine particles of the zirconium phosphate compound were obtained, of which the number average particle size was 124 nm.

<Production Example of Toner Particle>

<Toner Particle 1>

(process of forming convex)

The following samples were weighed in a reaction vessel, and were mixed using a propeller stirring blade; and a mixed liquid was obtained.

| | |
|---|---|
| Dispersion liquid of toner base particles | 500.0 parts |
| Liquid of organosilicon compound | 35.0 parts |

Next, the pH of the obtained mixed liquid was adjusted to 9.5 using an aqueous solution of 1.0 mol/L NaOH, and the temperature of the mixed liquid was adjusted to 50° C.; and then while being mixed using a propeller stirring blade, the mixture was kept for 1.0 hour.

(Process of Depositing Metal Salt of Polyvalent Acid)

| | |
|---|---|
| Aqueous solution of 44% titanium lactate (trade name: TC-310: produced by Matsumoto Fine Chemical Co., Ltd.) 3.2 parts (which corresponded to 1.4 parts of titanium lactate) | |
| Liquid of organosilicon compound | 10.0 parts |

Subsequently, the above materials were weighed and mixed in a reaction vessel; and then the pH of the obtained mixed liquid was adjusted to 9.5 using an aqueous solution of 1.0 mol/L NaOH, and the mixture was kept for 4.0 hours. The temperature was lowered to 25° C., then the pH was adjusted to 1.5 with 1.0 mol/L hydrochloric acid, and the mixture was stirred for 1.0 hour; and then the mixture was filtrated while being washed with ion-exchanged water. The obtained powder was dried in a constant temperature bath, and then was classified with a wind force type classifier; and the toner particles 1 were obtained. A number average particle size (D1) of the toner particles 1 was 6.2 μm, and a weight average particle size (D4) thereof was 6.9 μm. The toner particle 1 was analyzed and observed with a transmission electron microscope and energy dispersive X-ray spectroscopy (TEM-EDX); and as a result, a convex portion was observed on the surface of the toner particle, which contained an organosilicon polymer, and it was confirmed that titanium existed on the surface of the convex portion. The convex height H was 60 nm. In addition, the toner particle 1 was analyzed by time-of-flight secondary ion mass spectrometry (TOF-SIMS analysis), and thereby an ion originating in titanium phosphate was detected.

For information, the titanium phosphate compound is a reaction product between titanium lactate and a phosphate ion that is derived from sodium phosphate or calcium phosphate which originates in the aqueous medium.

<Toner Particle 2>

(Process of Depositing Metal Salt of Polyvalent Acid)

The following samples were weighed in a reaction vessel, and were mixed using a propeller stirring blade; and a mixed liquid was obtained.

| | |
|---|---|
| Dispersion liquid of toner base particles | 500.0 parts |
| Aqueous solution of 44% titanium lactate (trade name: TC-310:produced by Matsumoto Fine Chemical Co., Ltd.) 3.2 parts (which corresponded to 1.4 parts of titanium lactate) | |
| Liquid of organosilicon compound | 10.0 parts |

Next, the pH of the obtained mixed liquid was adjusted to 9.5 using an aqueous solution of 1.0 mol/L NaOH, and the mixture was kept for 5.0 hours. The temperature was lowered to 25° C., then the pH was adjusted to 1.5 with 1.0 mol/L hydrochloric acid, and the mixture was stirred for 1.0 hour; and then the mixture was filtrated while being washed with ion-exchanged water. The obtained powder was dried in a constant temperature bath, and then was classified with a wind force type classifier; and the toner particles 2 were obtained. The number average particle size (D1) of the toner particles 2 was 6.2 μm, and the weight average particle size (D4) thereof was 6.9 μm. The toner particle 2 was observed with TEM-EDX, and as a result, the organosilicon polymer existed on the surface of the toner particle, but the convex portion was not formed. In addition, it was confirmed that titanium existed on the surface of the toner particle. Furthermore, the toner particle 2 was analyzed by TOF-SIMS, and as a result, an ion originating in titanium phosphate was detected.

For information, the titanium phosphate compound is a reaction product between titanium lactate and a phosphate ion that is derived from sodium phosphate or calcium phosphate which originates in the aqueous medium.

<Toner Particle 3>

Toner particle 3 was obtained in the same manner as in the Production Example of the toner particle 2, except that in place of 3.2 parts of the aqueous solution of 44% titanium lactate (trade name: TC-310: produced by Matsumoto Fine Chemical Co., Ltd.), in the Production Example of the toner particle 2, 11.7 parts of zirconium lactate ammonium salt (trade name: ZC-300, Matsumoto Fine Chemical Co., Ltd.) was added, (which corresponded to 1.4 parts of zirconium lactate ammonium salt). The number average particle size (D1) of the toner particles 3 was 6.2 μm, and the weight average particle size (D4) thereof was 6.9 μm. The toner particle 3 was observed with TEM-EDX, and as a result, the organosilicon polymer existed on the surface of the toner particle, but the convex portion was not formed. In addition, it was confirmed that zirconium existed on the surface of the toner particle. Furthermore, the toner particle 3 was analyzed by TOF-SIMS, and as a result, an ion originating in zirconium phosphate was detected. For information, the zirconium phosphate compound is a reaction product between zirconium lactate ammonium salt and a phosphate ion that is derived from sodium phosphate or calcium phosphate which originates in the aqueous medium.

<Toner Particle 4>

The following samples were weighed in a reaction vessel, and were mixed using a propeller stirring blade.

| | |
|---|---|
| Dispersion liquid of toner base particles | 500.0 parts |

Next, while the temperature was kept at 25° C., the pH was adjusted to 1.5 with 1.0 mol/L hydrochloric acid, and the mixture was stirred for 1.0 hour; and then the mixture was filtrated while being washed with ion-exchanged water. The obtained powder was dried in a constant temperature bath, and then was classified with a wind force type classifier; and the toner particles 4 were obtained.

<Toner Particle 5>

Toner particle 5 was obtained in the same manner as in the Production Example of the toner particle 2, except that in the Production Example of the toner particle 2, the aqueous solution of 44% titanium lactate (trade name: TC-310: produced by Matsumoto Fine Chemical Co., Ltd.) was not added. The number average particle size (D1) of the toner particles 5 was 6.2 μm, and the weight average particle size (D4) thereof was 6.9 μm. The toner particle 5 was observed with TEM-EDX, and as a result, the organosilicon polymer existed on the surface of the toner particle, but the convex portion was not formed. In addition, a metallic element did not exist on the surface of the toner particle. Furthermore, the toner particle 5 was analyzed with TOF-SIMS, and as a result, an ion originating in the metal salt of a polyvalent acid was not detected.

<Method for Producing Toner>

<Toner 1, 2, 3 and 5>

The toner particles 1, 2, 3 and 5 were used as toners 1, 2, 3 and 5.

<Toner 4>

| | |
|---|---|
| Toner particle 4 | 100.0 parts |
| Fine particles of hydrophobic silica (hexamethyldisilazane treatment: number average particle size 12 nm) | 1.0 part |
| Fine particles of metal salt of polyvalent acid | 2.0 parts |

The above materials were charged into SUPERMIXER PICCOLO SMP-2 (manufactured by Kawata MFG Co., Ltd.), and were mixed at 3,000 rpm for 20 minutes. After that, sieving was performed with a mesh having openings of 150 μm, and the toners 4 were obtained. The number average particle size (D1) of the toners 4 was 6.2 μm, and the weight average particle size (D4) thereof was 6.9 μm. The toner 4 was observed with TEM-EDX, and as a result, the organosilicon polymer did not exist on the surface of the toner particle. In addition, it was confirmed that zirconium existed on the surface of the toner particle. The toner 4 was analyzed by TOF-SIMS, and as a result, an ion originating in zirconium phosphate was detected.

<Method for Calculating Convex Height H>

Observe the cross section of the toner particle by using a transmission electron microscope (TEM), by the following method.

Firstly, sufficiently disperse the toner particles in a room-temperature curable epoxy resin, and then cure the resin in an atmosphere of 40° C. for 2 days.

Cut out a flaky sample having a thickness of 50 nm from the obtained cured product, by using a microtome (trade name: EMUC7: manufactured by Leica Microsystems) equipped with a diamond blade.

Observe the cross section of the toner particles in this sample, by using a TEM (trade name: JEM2800, manufactured by JEOL Ltd.) which has been set at a magnification of 500000 times under conditions of an acceleration voltage of 200 V and an electron beam probe size of 1 mm. At this time, select such a cross section of the toner particle as to have the maximum diameter which is 0.9 times to 1.1 times of the number average particle size (D1) at the time when the number average particle size (D1) of the toners has been measured according to a method for measuring the size of toner particles, which will be described later. Subsequently, analyze constituent elements in the obtained cross section of the toner particles by using energy dispersive X-ray spectroscopy (EDX), and produce EDX mapping images (256×256 pixels (2.2 nm/pixel), cumulative times 200 times).

In the produced EDX mapping image, in the case where a signal originating from a silicon element is observed on the surface of the toner base particle, determine the above signal as an image of the organosilicon polymer. In addition, in the case where an image of the organosilicon polymer is continuously observed on the surface of the toner base particle, determine a line segment which connects end points of the image of the organosilicon polymer to each other, as a base line. Here, the end point of the image of the organosilicon polymer is determined to be a portion at which the intensity of the signal originating in silicon becomes equal to the intensity of silicon in the background.

For each base line, draw vertical lines from the base line to the image surface of the organosilicon polymer, search the vertical line having the maximum length from among the vertical lines, and determine the maximum length as the convex height. Analyze cross sections of 20 toner particles according to the above method, and determine the average value of the obtained convex heights as the convex height H (nm).

<Method for Calculating Ratios M1 and M2 of Metal Element M Using X-Ray Photoelectron Spectroscopy>

Treatment (a)

Add 160 g of sucrose (produced by Kishida Chemical Co., Ltd.) into 100 mL of ion-exchanged water, and dissolve the sucrose into the water using a water bath, and prepare an aqueous solution of 61.5% sucrose. Charge 31.0 g of a concentrated solution of the above sucrose in a tube for centrifugal separation, an 6 g of Contaminon N (trade name) (aqueous solution of 10% by mass neutral detergent having a pH of 7 for washing precision measuring instruments, which includes nonionic surfactant, anionic surfactant and organic builder, produced by Fujifilm Wako Pure Chemical Corporation), and prepare the dispersion liquid. Add 1.0 g of a toner to this dispersion, and loosen a lump of the toner with a spatula or the like. Shake the tube for the centrifugal separation with a shaker at 300 spm (strokes per min) for 20 minutes. After the shaking, shift the solution to a glass tube (50 mL) for a swing rotor, and separate the toner from the solution by a centrifugal machine at 3500 rpm for 30 minutes. Visually confirm that the toner and the aqueous solution are sufficiently separated, and collect the separated toner in the uppermost layer, with a spatula or the like. Filtrate the collected toner with a vacuum filter, followed by drying with a dryer for 1 hour or longer. Crush the dried product with a spatula, and obtain a toner (a).

Measurement was conducted for the toner of the present disclosure and the above toner (a) by using X-ray photoelectron spectroscopy as is described in the followings, and calculate the above M1 and M2.

Measure the constituent elements of the toners under the following conditions, and calculate the proportion M1 and proportion M2 of the metal element M.

Measuring apparatus: X-ray photoelectron spectrometer: (product name: Quantum 2000 (manufactured by ULVAC-PHI, Inc.))

X-ray source: monochrome Al Kα

X-ray setting: 100 μmΦ (25 W (15 KV))

Take-off angle of photoelectron: 45 degrees

Neutralization condition: concomitant use of neutralizing gun and ion gun

Analysis area: 300×200 μm

Pass energy: 58.70 eV

Step size: 0.1.25 eV

Analysis software: Multipack (ULVAC-PHI, Inc.)

Here, for example, in order to calculate a quantitative value of Ti atoms, use a peak of Ti2p (B. E. 452 to 468 eV). The quantitative value of the Ti element obtained here is determined to be M1 (atm %).

Measurement was conducted for the toner of the present disclosure and the above toner (a) using the above method, and the proportions of the metal element M of each of the toners are determined to be M1 (atm %) and M2 (atm %), respectively.

<Method for Detecting Metal Salt of Polyvalent Acid>

Detect a metal salt of a polyvalent acid on the surface of the toner particle by using the time-of-flight secondary ion mass spectrometry (TOF-SIMS), according to the following method.

Analysis is made for the toner sample by using TOF-SIMS (trade name: TRIFTIV, manufactured by ULVAC-PHI, Inc.) under the following conditions.

Primary ion species: gold ion (AO

Current value of primary ions: 2 pA

Analysis area: 300×300 $\mu m^2$

Number of pixels: 256×256 pixels

Analysis time period: 3 min

Repetition frequency: 8.2 kHz

Charge neutralization: ON

Polarity of secondary ion: Positive

Range of secondary ion mass: m/z 0.5 to 1850

Sample board: indium

Analysis is made under the above conditions, and in the case where a peak is detected which originates in secondary ions containing a metal ion and a polyvalent acid ion (for example, in the case of titanium phosphate, $TiPO_3$ (m/z 127) or $TiP_2O_5$ (m/z 207)), determine that the metal salt of the polyvalent acid exists on the surface of the toner particle.

Table 1 shows the physical properties of the toners 1 to 5.

TABLE 1

Table 1

| | Metal salt of polyvalent acid | Organo-silicon polymer | Convex portion | Convex height H (nm) | M1 (atom %) | M2/M1 |
|---|---|---|---|---|---|---|
| Toner 1 | Ti phosphate | Present | Present | 60 | 3.3% | 0.99 |
| Toner 2 | Ti phosphate | Present | Absent | — | 2.7% | 0.99 |
| Toner 3 | Zr phosphate | Present | Absent | — | 2.7% | 0.99 |
| Toner 4 | Zr phosphate | Absent | Absent | — | 0.2% | 0.50 |
| Toner 5 | Absent | Present | Absent | — | — | — |

<Production of Electrophotographic Photosensitive Member>

(Production Example 1 for Electrophotographic Photosensitive Member)

An aluminum cylinder (JIS-A3003, aluminum alloy) having a diameter of 24 mm and a length of 257.5 mm was used as a support (electroconductive support).

(Formation of Electroconductive Layer)

Next, the following materials were prepared.

(Metal Oxide Particle 1)

As the metal oxide particle 1, titanium oxide was used that was coated with titanium oxide which was doped with niobium, and that was produced by the following production method.

Titanium dioxide of the core material can be produced by a known sulfuric acid method. Specifically, the titanium dioxide is obtained by an operation of heating a solution containing titanium sulfate, titanyl sulfate or the like to hydrolyze the compound to produce a metatitanic acid slurry, and dehydrating and firing the metatitanic acid slurry.

As the core material particles, anatase type titanium oxide particles were used which had an average primary particle size of 200 nm. A titanium niobium sulfate solution was prepared which contained 33.7 g of titanium in terms of $TiO_2$ and 2.9 g of niobium in terms of $Nb_2O_5$. In pure water, 100 g of the core material particles were dispersed to prepare 1 L of a suspension liquid, and the suspension liquid was heated to 60° C. The titanium niobium sulfate solution and 10 mol/L sodium hydroxide were added dropwise to the suspension liquid over 3 hours so that a pH of the suspension liquid became 2 to 3. After the whole quantity was added dropwise, the pH was adjusted to the vicinity of neutrality, and a flocculant was added to precipitate a solid content. The supernatant was removed, the rest was filtered, and the residue was washed and then dried at 110° C. to obtain an intermediate body containing 0.1 wt % of an organic substance derived from the flocculant in terms of C. This intermediate was calcined in nitrogen gas at 750° C. for 1 hour, the temperature was lowered to 450° C.; and then the intermediate was calcined in oxygen gas for 1 hour, and a metal oxide particle 1 was produced.

[Preparation of Coating Liquid for Electroconductive Layer]

(Coating Liquid 1 for Electroconductive Layer)

A phenolic resin (phenolic resin monomer/oligomer) (trade name: Plyorphen J-325, produced by DIC Corporation, resin solid content: 60%, and density after curing: 1.3 $g/cm^3$) of a binder material in an amount of 80 parts was dissolved in 60 parts of 1-methoxy-2-propanol of a solvent to obtain the solution.

To the solution, 160 parts of the metal oxide particle 1 was added; the resultant liquid was used as a dispersion medium, and was charged into a vertical sand mill which used 200 parts of glass beads having an average particle size of 1.0 mm; the mixture was subjected to a dispersion treatment under conditions of a dispersion liquid temperature of 23±3° C. and a number of revolutions of 1500 rpm (circumferential velocity: 5.5 m/s) for 2 hours; and a dispersion liquid was obtained. The glass beads were removed from the dispersion liquid by a mesh. A dispersion liquid from which the glass beads were removed was pressurized and filtrated using a PTFE filter paper (trade name: PF060, produced by Advantec Toyo Kaisha, Ltd.). Into the dispersion liquid after the pressure filtration, 0.015 parts of silicone oil (trade name: SH28 PAINT ADDITIVE, produced by Dow Corning Toray Co., Ltd.) were added as a leveling agent, and 15 parts of silicone resin particles (trade name: Tospearl 120, produced by Momentive Performance Materials Inc., average particle size: 2 μm) were added as a surface roughness imparting material, and the mixture was stirred; and thereby a coating liquid 1 for the electroconductive layer was prepared.

The support was dip coated with this coating liquid for an electroconductive layer, the resulting coating film was heated at 150° C. for 30 minutes, and thereby an electroconductive layer having a film thickness of 25.0 μm was formed.

(Formation of Undercoat Layer)

The following materials were prepared.

An electron transport substance represented by the following Formula (ET-1) in an amount of 4 parts Blocked isocyanate (trade name: Duranate SBN-70D, produce by Asahi Kasei Corporation) in an amount of 5.5 parts Polyvinyl butyral resin (trade name: S-LEC KS-5Z, produced by Sekisui Chemical Co., Ltd.) in an amount of 0.3 parts Zinc (II) hexanoate (produced by Mitsuwa Chemicals Co., Ltd.) which functioned as a catalyst, in an amount of 0.05 parts These materials were dissolved in a mixed solvent of 50 parts of tetrahydrofuran and 50 parts of 1-methoxy-2-propanol, and a coating liquid for the undercoat layer was prepared. The electroconductive layer was dip coated with this coating liquid for the undercoat layer, and the resulting coating film was heated at 170° C. for 30 minutes, and thereby an undercoat layer having a film thickness of 0.7 μm was formed.

(ET-1)

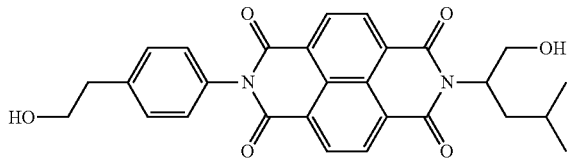

(Formation of Charge Generation Layer)

Next, 10 parts of hydroxygallium phthalocyanine having a crystalline form which had peaks at positions of 7.5° and 28.4° in a chart obtained from CuKα characteristic X-ray diffraction, and 5 parts of a polyvinyl butyral resin (trade name: S-LEC BX-1; produced by Sekisui Chemical Co., Ltd.) were prepared. These materials were added to 200 parts of cyclohexanone, and the solid content was dispersed for 6 hours with a sand mill apparatus which used glass beads having a diameter of 0.9 mm; 150 parts of cyclohexanone and 350 parts of ethyl acetate were further added to the dispersion liquid, and the mixture was diluted; and a coating liquid for the charge generation layer was obtained. The undercoat layer was dip-coated with the obtained coating liquid, the obtained coating film was dried at 95° C. for 10 minutes, and thereby the charge generation layer having a film thickness of 0.20 μm was formed. Note that the measurement with the X-ray diffraction was performed under the following conditions.

[Powder X-Ray Diffraction Measurement]

Employed measurement instrument: X-ray diffractometer RINT-TTRII, manufactured by Rigaku Corporation X-ray bulb: Cu
Tube voltage: 50 KV
Tube current: 300 mA
Scanning method: 2θ/θscanning
Scanning speed: 4.0°/min
Sampling interval: 0.02°
Start angle (2θ): 5.0°
Stop angle (2θ): 40.0°
Attachment: standard sample holder
Filter: not used
Incident monochrome: used
Counter monochromator: not used
Divergence slit: open
Divergence vertical restriction slit: 10.00 mm
Scattering slit: open
Light receiving slit: open
Flat plate monochromator: used
Counter: scintillation counter (Formation of Charge Transport Layer)

Next, the following materials were prepared.

A compound represented by the following Formula (C-1) (charge transport substance (hole transporting compound)) 6 parts A compound represented by the following Formula (C-2) (charge transport substance (hole transporting compound)) 3 parts A compound represented by the following Formula (C-3) (charge transport substance (hole transporting compound)) 1 part Polycarbonate (trade name: Iupilon Z400, produced by Mitsubishi Engineering-Plastics Corporation) 10 parts A polycarbonate resin having a copolymerized unit represented by (C-4) 0.02 parts (Mw=23,000)

(C-1)

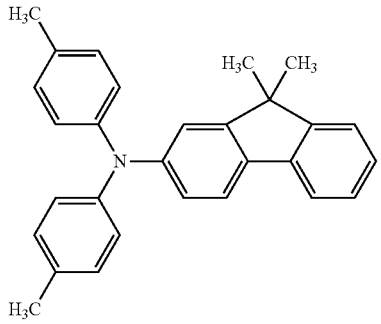

(C-2)

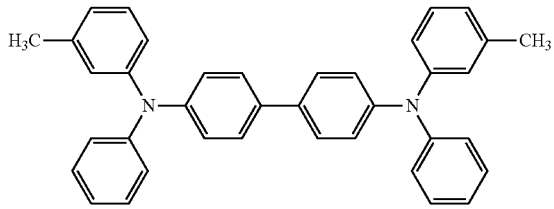

(C-3)

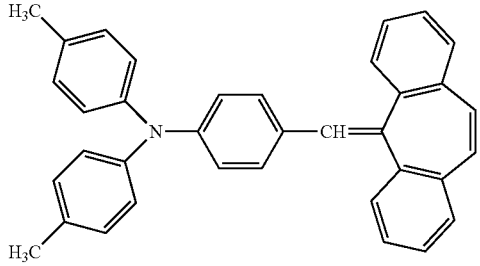

-continued (C-4)

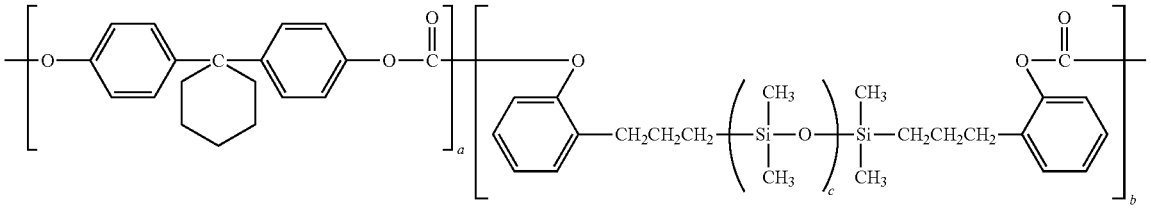

a:b = 9:1

(In Formula (C-4), a:b means a molar ratio of a structure in [ ]; and c represents an average value of the number of repetitions of the structure in parentheses, and c=20.)

These materials were dissolved in a mixed solvent of 25 parts of o-xylene/15 parts of methyl benzoate/35 parts of dimethoxymethane, and thereby a coating liquid for the charge transport layer was prepared. The charge generation layer was dip-coated with the coating liquid for the charge transport layer to have a coating film formed thereon; and the coating film was dried at 120° C. for 30 minutes, and thereby the charge transport layer was formed which had a film thickness of 16 μm.

(Formation of Surface Layer)

The following materials were prepared.

| | |
|---|---|
| A compound represented by the following Formula (A-1-2) | 10 parts |
| A compound represented by the following Formula (A-2-5) | 10 parts |
| 1-Propanol | 50 parts |
| 1,1,2,2,3,3,4-Heptafluorocyclopentane (trade name: Zeorora H, produced by Zeon Corporation) | 25 parts |

(A-1-2)

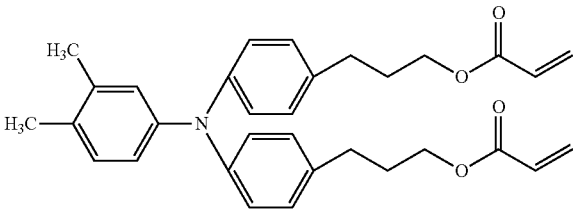

(A-2-5)

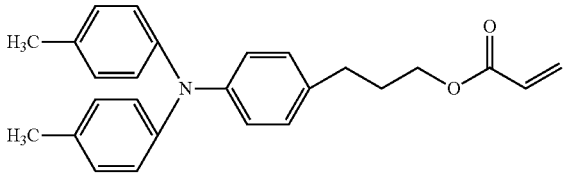

These materials were mixed and stirred. After that, this solution was filtrated through a polyflon filter (trade name: PF-020, manufactured by Advantec Toyo Kaisha Ltd.), and thereby a coating liquid for the surface layer was prepared.

The charge transport layer was dip-coated with the coating liquid for the surface layer to have a coating film formed thereon, and the obtained coating film was dried at 50° C. for 6 minutes. After that, in a nitrogen atmosphere, the coating film was irradiated with an electron beam for 1.6 seconds, under the conditions of an acceleration voltage of 70 kV and a beam current of 5.0 mA, while the support (body to be irradiated) was rotated at a speed of 200 rpm. For information, the absorbed dose of the electron beam at this time was measured, and as a result, was 15 kGy. After that, in a nitrogen atmosphere, the temperature of the coating film was raised from 25° C. until the temperature reached 117° C., over 30 seconds, and the coating film was heated. A concentration of oxygen in a period between the electron beam irradiation and the subsequent heat treatment was 15 ppm or lower. Next, in the air, the coating film was naturally cooled until the temperature of the coating film reached 25° C., and was subjected to heat treatment for 30 minutes under the condition that the temperature of the coating film became 105° C., and the surface layer having a film thickness of 3 μm was formed.

Figure 2:
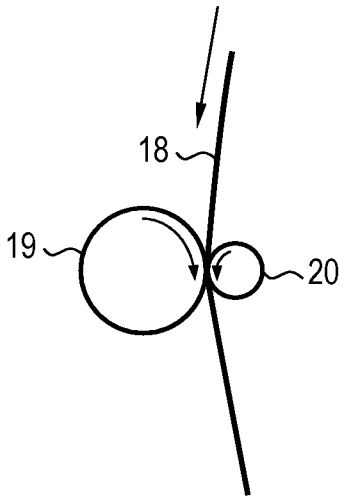
FIG. 2 illustrates a view illustrating an example of a polishing apparatus which is used for roughening a surface of a surface layer of the electrophotographic photosensitive member.

After the surface layer was formed, the surface of the electrophotographic photosensitive member was polished using a polishing apparatus illustrated in FIG. 2 to be roughened.

In FIG. 2, the polishing sheet 18 is wound in the direction of the arrow by a winding mechanism (not illustrated). The electrophotographic photosensitive member 19 rotates in the arrow direction, and the backup roller 20 rotates in the arrow direction.

As the polishing sheet 18, a polishing sheet (trade name: GC #3000, thickness of base layer sheet: 75 μm) was used, which was produced by Riken Corundum Co., Ltd. In addition, a urethane roller (outer diameter: 50 mm) having a hardness of 20° was used as the backup roller 20. As for the polishing conditions, the penetration amount was set at 2.5 mm, the sheet feeding amount was set at 400 mm/s, and the feeding direction of the polishing sheet and the rotating direction of the electrophotographic photosensitive member were set at the same direction; and the surface of the electrophotographic photosensitive member was polished for 15 seconds.

In this way, a cylindrical (drum-shaped) electrophotographic photosensitive member 1 of Example 1 was produced, which had a support, an undercoat layer, a charge generation layer, a charge transport layer and a surface layer, in this order.

[Evaluation of Electrophotographic Photosensitive Member]

<Measurement of Roughness of Surface Layer of Electrophotographic Photosensitive Member>

The surface roughness of the surface layer of the electrophotographic photosensitive member after polishing was measured using a surface roughness measuring machine (trade name: SE700, SMB-9, manufactured by Kosaka Laboratory Ltd.), under the following conditions. As for the measurement, ten-point average surface roughness (Rzjis) was measured by sweep in the circumferential direction, and average spacing (RSm) was measured by sweep in the circumferential direction, each according to JIS B0601-2001 standard.

The surface roughness was measured at positions of 30, 70, 150 and 210 mm from the upper end of the coating, in the longitudinal direction of the electrophotographic photosensitive member. In addition, after the electrophotographic photosensitive member was rotated by 120° toward an operator, and the surface roughness was measured at positions of 30, 70, 150 and 210 mm from the upper end of the coating, in the same manner. After the electrophotographic photosensitive member was rotated further by 120° toward the operator, the surface roughness was measured in the same manner, and Rzjis and RSm were determined from the average value of measured values at 12 points in total. The measurement conditions were set in the following way. Measurement length: 2.5 mm, cutoff value: 0.8 mm, feeding speed: 0.1 mm/s, filter characteristics: 2CR, and leveling: straight line (whole area).

Table 2 shows the obtained evaluation results.

<Measurement of Film Thicknesses of Charge Transport Layer and Surface Layer>

The film thickness of the charge transport layer was measured with a film thickness measuring machine, Fischer MMS eddy current method probe EAW3.3 manufactured by Fischer Instruments K.K.

The film thickness of the surface layer was measured using an interference film thickness meter (trade name: MCPD-3700, manufactured by Otsuka Electronics Co., Ltd.).

(Production Example 2 of Electrophotographic Photosensitive Member)

An electrophotographic photosensitive member 2 was produced in the same manner as the electrophotographic photosensitive member 1, except that the compounds which were used for forming the surface layer in the production of the electrophotographic photosensitive member 1 were changed to 8.2 parts of a compound represented by the Formula (A-1-2), 1.8 parts of a compound represented by the Formula (A-2-5) and 12 parts of a compound represented by the Formula (B-1-1) which did not have the charge transport function, and the surface roughness was changed to values shown in Table 3.

(Production Example 3 of Electrophotographic Photosensitive Member)

An electrophotographic photosensitive member 3 was produced in the same manner as the electrophotographic photosensitive member 1, except that the compounds which were used for forming the surface layer in the production of the electrophotographic photosensitive member 1 were changed to 10 parts of a compound represented by the Formula (A-2-8), 2 parts of a compound represented by the following Formula (D-1) and 7 parts of a compound represented by the following Formula (D-2), and the surface roughness was changed to values shown in Table 3.

(D-1)

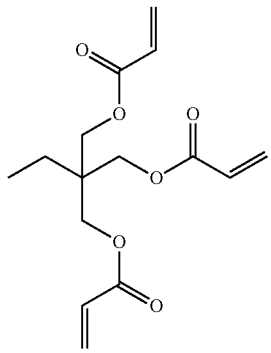

-continued (D-2)

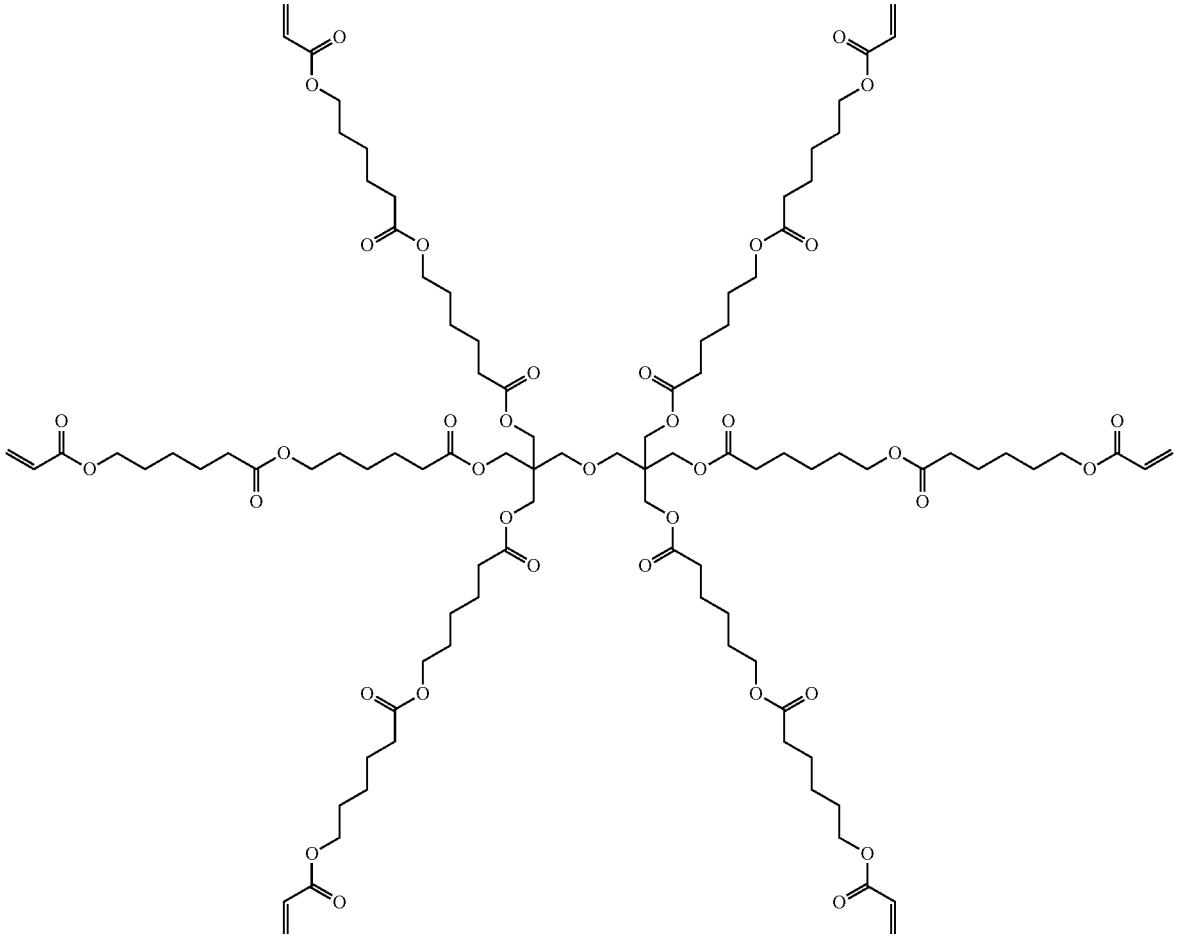

(Production Example 4 of Electrophotographic Photosensitive Member)

An electrophotographic photosensitive member 4 was produced in the same manner as the electrophotographic photosensitive member 1, except that the compounds which were used for forming the surface layer in the production of the electrophotographic photosensitive member 1 were changed to 10 parts of a compound represented by the following Formula (D-3), and 150 parts by mass of a tin oxide particle (volume average particle size: 20 nm), and the surface roughness was changed to values shown in Table 3.

(D-3)

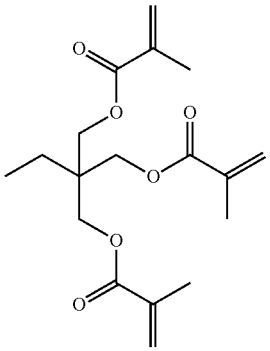

(Production Example 5 of Electrophotographic Photosensitive Member)

An electrophotographic photosensitive member 5 was produced in the same manner as the production Example 2 of electrophotographic photosensitive member, except that the surface roughness in the production of the electrophotographic photosensitive member 2 was changed to values shown in Table 3.

(Production Example 6 of Electrophotographic Photosensitive Member)

The electrophotographic photosensitive member 6 was produced in the same manner as the production Example 2 of electrophotographic photosensitive member, except that the film thickness of the surface layer in the production of the electrophotographic photosensitive member 2 was changed to 6 μm, and the surface roughness was changed to values shown in Table 3.

(Production Example 7 of Electrophotographic Photosensitive Member)

An electrophotographic photosensitive member 7 was produced in the same manner as the electrophotographic photosensitive member 1, except that the compounds which were used for forming the surface layer in the production of the electrophotographic photosensitive member 4 were changed to 4 parts of a compound represented by Formula (D-3), and 10 parts by mass of a compound represented by Formula (C-2), and the surface roughness was changed to values shown in Table 3.

(Production Example 8 of Electrophotographic Photosensitive Member)

A coating liquid for the charge transport layer and the surface layer was prepared by an operation of dissolving 6 parts of a compound represented by Formula (C-1), 3 parts of a compound represented by Formula (C-2), and 1 part of a compound represented by Formula (C-3), and 10 parts of polycarbonate (trade name: Iupilon Z400, produced by Mitsubishi Engineering-Plastics Co., Ltd.), into a mixed solvent of 25 parts of o-xylene/15 parts of methyl benzoate/35 parts of dimethoxymethane, in the production of the electrophotographic photosensitive member. The charge generation layer was dip-coated with this coating liquid to have a coating film formed thereon, and the coating film was dried at 120° C. for 30 minutes; and thereby a charge transport layer was formed which had a film thickness of 16 μm, and an electrophotographic photosensitive member 8 was produced.

Table 2 shows Production Examples of electrophotographic photosensitive members 1 to 8.

TABLE 2

Table 2

| Production Example of electrophotographic photosensitive member | Monomer for forming acrylic or methacrylic resin: Monomer for forming resin having structure represented by Formula (A-1) | | Monomer for forming resin having structure represented by Formula (A-2) | | Monomer for forming resin having structure represented by Formula (B-1) or (B-2) | | Monomer having other structure | |
|---|---|---|---|---|---|---|---|---|
| | Structure | Content (parts) | Structure | Content (parts) | Structure | Content (parts) | Structure | Content (parts) |
| Electrophotographic photosensitive member 1 | (A-1-2) | 10 | (A-2-5) | 10 | — | | | |
| Electrophotographic photosensitive member 2 | (A-1-2) | 10 | (A-2-5) | 1.8 | (B-1-1) | 12 | | |
| Electrophotographic photosensitive member 3 | — | — | (A-2-8) | 10 | — | — | (D-1)/(D-2) | 7/3 |
| Electrophotographic photosensitive member 4 | — | — | — | — | — | — | (D-3) | 10 |
| Electrophotographic photosensitive member 5 | (A-1-2) | 10 | (A-2-5) | 10 | — | | | |
| Electrophotographic photosensitive member 6 | (A-1-2) | 10 | (A-2-5) | 1.8 | (B-1-1) | 12 | | |
| Electrophotographic photosensitive member 7 | — | — | — | — | — | — | (D-3) | 4 |
| Electrophotographic photosensitive member 8 | — | — | — | — | — | — | — | — |

| Production Example of electrophotographic photosensitive member | Contents other than acrylic resin | | Content of acrylic resin (% by mass) | Physical properties of surface layer: Film thickness (μm) | Ra (μm) | Sm (mm) |
|---|---|---|---|---|---|---|
| | Name | Content (parts) | | | | |
| Electrophotographic photosensitive member 1 | | | 100 | 3 | 0.014 | 0.018 |
| Electrophotographic photosensitive member 2 | | | 100 | 3 | 0.011 | 0.018 |
| Electrophotographic photosensitive member 3 | | | 50 | 3 | 0.042 | 0.058 |
| Electrophotographic photosensitive member 4 | Tin oxide | 10 | 50 | 3 | 0.012 | 0.007 |
| Electrophotographic photosensitive member 5 | | | 100 | 3 | 0.008 | 0.022 |
| Electrophotographic photosensitive member 6 | | | 100 | 6 | 0.012 | 0.018 |
| Electrophotographic photosensitive member 7 | (C-2) | 10 | 28 | 3 | 0.021 | 0.032 |

TABLE 2-continued

Table 2

| | | | | | | |
|---|---|---|---|---|---|---|
| Electrophotographic photosensitive member 8 | 0 | — | 0 | 16 | — | — |

Examples 1 to 10 and Comparative Examples 1 to 3

Combinations as shown in Table 3 were prepared using the above toners 1 to 5 and the electrophotographic photosensitive members 1 to 8, and were subjected to the evaluation of image fogging.

The evaluation method and evaluation criteria of the present disclosure will be described below.

As the image forming apparatus, a modified machine and a commercially available process cartridge were used, which was a commercially available laser printer LBP-712Ci (manufactured by Canon Inc.) of which the process speed was set at 200 mm/sec. From the inside of the cartridge, the toner of the product was removed; the inside of the cartridge was cleaned by air blow, then was filled with 165 g of the toner of the present disclosure; and the electrophotographic photosensitive member was replaced with the electrophotographic photosensitive member of the present disclosure.

In addition, the toner of the product was drawn out from each of the cartridges of yellow, magenta and black, and cartridges of yellow, magenta and black, in which mechanisms for sensing the remaining amounts of the toners were disabled, were inserted into respective stations; and were used for the evaluation.

<Evaluation of Image Fogging>

In gloss paper mode (⅓ speed), letter size HP Brochure Paper 200 g, Glossy (basis weight 200 g/cm$^2$) was used, and 75 mm×75 mm paper (Post-it produced by 3M Japan Limited) was attached to the center position; and a solid white image with 0% printing ratio was printed out.

The attached paper was removed from the print-out image, and measurement was conducted using "REFLECTMETER MODEL TC-6DS" (trade name) (manufactured by Tokyo Denshoku Co., Ltd.). The fog density (%) was calculated from the difference between the whiteness of the white background portion of the printed print-out image and the whiteness of the transfer paper (the portion from which the attached paper was removed), and the image fogging was evaluated. An amber filter was used as the filter.

The evaluation results are shown in Table 3.

TABLE 3

| | Production Example of toner | Production Example of electrophotographic photosensitive member | Fog density |
|---|---|---|---|
| Example 1 | Toner 1 | Electrophotographic photosensitive member 1 | 0.25% |
| Example 2 | Toner 1 | Electrophotographic photosensitive member 2 | 0.22% |
| Example 3 | Toner 1 | Electrophotographic photosensitive member 3 | 0.27% |
| Example 4 | Toner 1 | Electrophotographic photosensitive member 4 | 0.45% |
| Example 5 | Toner 1 | Electrophotographic photosensitive member 5 | 0.33% |
| Example 6 | Toner 1 | Electrophotographic photosensitive member 6 | 0.45% |
| Example 7 | Toner 1 | Electrophotographic photosensitive member 7 | 0.55% |
| Example 8 | Toner 2 | Electrophotographic photosensitive member 2 | 0.38% |
| Example 9 | Toner 3 | Electrophotographic photosensitive member 2 | 0.45% |
| Example 10 | Toner 4 | Electrophotographic photosensitive member 2 | 0.88% |
| Comparative Example 1 | Toner 5 | Electrophotographic photosensitive member 2 | 1.83% |
| Comparative Example 2 | Toner 4 | Electrophotographic photosensitive member 8 | 1.50% |
| Comparative Example 3 | Toner 5 | Electrophotographic photosensitive member 8 | 1.88% |

While the present disclosure has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-137130, filed Jul. 25, 2019, and Japanese Patent Application No. 2020-113407, filed Jun. 30, 2020, which are hereby incorporated by reference herein in their entirety.

What is claimed is:

1. A process cartridge configured to be detachably attachable to a main body of an electrophotographic apparatus, comprising:

a developing unit containing a toner; and an electrophotographic photosensitive member having a surface layer containing an acrylic resin or a methacrylic resin, the toner comprising a toner particle having a metal salt of a polyvalent acid on at least on a part of a surface thereof, the metal salt of the polyvalent acid includes at least one metal element selected from the group consisting of metal elements belonging to Groups 3 to 3, wherein the acrylic or methacrylic resin has a structure represented by Formula (A)

(A)

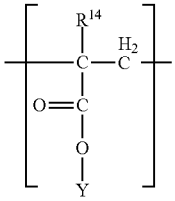

where $R^{14}$ represents a hydrogen atom or a methyl group, and Y represents a group having a triarylamine structure.

2. The process cartridge according to claim 1, wherein Formula (A) is represented by Formula (A-1) or Formula (A-2)

(A-1)

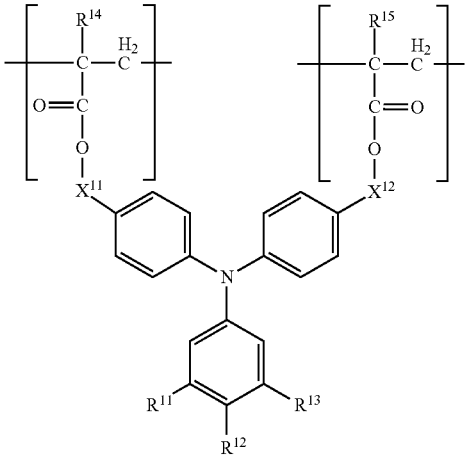

(A-2)

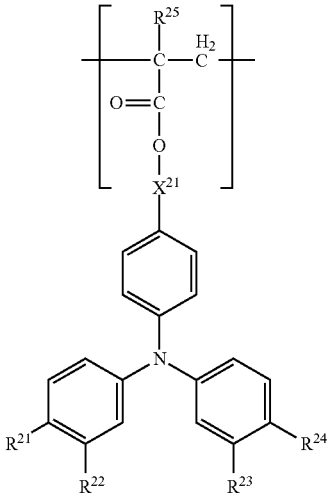

where $R^{11}$ to $R^{15}$ independently represent a hydrogen atom or a methyl group, $R^{21}$ to $R^{25}$ independently represent a hydrogen atom or a methyl group, $X^{11}$ and $X^{12}$ independently represent an alkylene group having 2 to 5 carbon atoms, or a phenylene group, and $X^{21}$ represents an alkylene group having 2 to 5 carbon atoms, or a phenylene group.

3. The process cartridge according to claim 1, wherein the metal element in the metal salt of the polyvalent acid is contained at a proportion M1 of 1.0 to 10.0 (atm %) of constituent elements on the toner particle surface as determined from a spectrum obtained by X-ray photoelectron spectroscopic analysis of the toner.

4. The process cartridge according to claim 1, wherein the acrylic resin or the methacrylic resin is contained at 30% by mass or more with respect to the surface layer of the electrophotographic photosensitive member.

5. The process cartridge according to claim 3, wherein $0.90 \leq M2/M1$ and both M1 and M2 are 1.0 to 10.0 (atm %) when M2 (atm %) is a proportion of the metal element in the metal salt of the polyvalent acid of constituent elements on the toner particle surface as determined from a spectrum obtained by X-ray photoelectron spectroscopic analysis of toner (a), where toner (a) is obtained by dispersing 1 g of the toner in a mixed aqueous solution containing 31 g of an aqueous solution of 61.5% sucrose and 6 g of an aqueous solution of 10% neutral surfactant for cleaning a precision measuring instrument containing a nonionic surfactant and an anionic surfactant, and subjecting the dispersion liquid to treatment by shaking the liquid using a shaker at 300 times per minute.

6. The process cartridge according to claim 1, wherein the acrylic or methacrylic resin has a structure represented by Formulae (B-1) or (B-2)

(B-1)

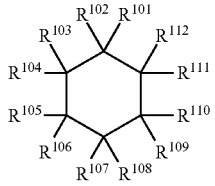

(B-2)

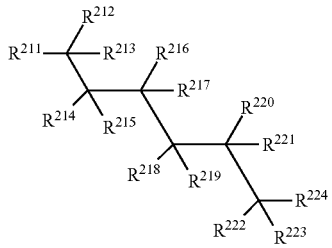

where among $R^{101}$ to $R^{112}$, at least two of $R^{101}$, $R^{105}$ and $R^{109}$ have a structure represented by Formula (B-3) and the remaining substituents independently represent a hydrogen atom or a methyl group, and among $R^{211}$ to $R^{224}$, $R^{211}$ and $R^{224}$ have a structure represented by Formula (B-3) and the remaining substituents independently represent a hydrogen atom or a methyl group, (B-3)

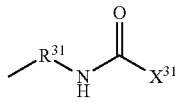

where $R^{31}$ represents a single bond or an optionally substituted methylene group, $X^{31}$ shows having a bond, and $X^{31}$ contains a structure represented by Formula (B-4)

(B-4)

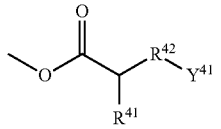

where $R^{41}$ represents a hydrogen atom or a methyl group, $R^{42}$ represents a methylene group, and $Y^{41}$ shows having a bond.

7. The process cartridge according to claim 1, wherein the surface layer of the electrophotographic photosensitive member has a film thickness of 3 μm or smaller, and is formed on a charge transport layer, and a film thickness of the charge transport layer is 17 μm or smaller.

8. The process cartridge according to claim 1, wherein the surface of the electrophotographic photosensitive member has a shape with $R_a$ of 0.010 to 0.045 μm and Sm of 0.005 to 0.060 mm.

9. The process cartridge according to claim 1, wherein the toner particle comprises a toner base particle containing a binder resin, and having an organosilicon polymer on a surface thereof.

10. The process cartridge according to claim 9, wherein the organosilicon polymer is contained in a convex portion on the toner base particle surface.

11. The process cartridge according to claim 10, wherein the convex portion has a height of 30 to 300 nm.

12. The process cartridge according to claim 10, wherein $H \times 0.1 < R_a < H$ where $R_a$ is a shape of the surface layer of the electrophotographic photosensitive member and H is a convex height of the toner.

13. An electrophotographic apparatus comprising a process cartridge configured to be detachably attachable to a main body of the electrophotographic apparatus, the process cartridge comprising:

a developing unit containing a toner; and an electrophotographic photosensitive member having a surface layer containing an acrylic resin or a methacrylic resin, the toner comprising a toner particle having a metal salt of a polyvalent acid on at least on a part of a surface thereof, the metal salt of the polyvalent acid includes at least one metal element selected from the group consisting of metal elements belonging to Groups 3 to 3, wherein the acrylic or methacrylic resin has a structure represented by Formula (A)

(A)

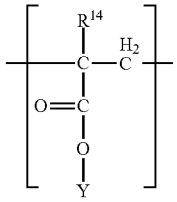

where $R^{14}$ represents a hydrogen atom or a methyl group, and Y represents a group having a triarylamine structure.

14. A process cartridge configured to be detachably attachable to a main body of an electrophotographic apparatus, comprising:

a developing unit containing a toner; and an electrophotographic photosensitive member having a surface layer containing an acrylic resin or a methacrylic resin, the toner comprising a toner particle having a metal salt of a polyvalent acid on at least on a part of a surface thereof, the metal salt of the polyvalent acid includes at least one metal element selected from the group consisting of metal elements belonging to Groups 3 to 13, wherein the toner particle comprises a toner base particle containing a binder resin, and having an organosilicon polymer on a surface thereof.

15. The process cartridge according to claim 14, wherein the organosilicon polymer is contained in a convex portion on the toner base particle surface.

16. The process cartridge according to claim 15, wherein the convex portion has a height of 30 to 300 nm.

17. The process cartridge according to claim 15, wherein $H \times 0.1 < R_a < H$ where $R_a$ is a shape of the surface layer of the electrophotographic photosensitive member and H is a convex height of the toner.

* * * * *